US010103499B2

(12) United States Patent
Tsai

(10) Patent No.: US 10,103,499 B2
(45) Date of Patent: Oct. 16, 2018

(54) ELECTRIC CONNECTOR

(71) Applicant: Chou Hsien Tsai, New Taipei (TW)

(72) Inventor: Chou Hsien Tsai, New Taipei (TW)

( * ) Notice: Subject to any disclaimer, the term of this patent is extended or adjusted under 35 U.S.C. 154(b) by 0 days.

(21) Appl. No.: 15/321,435

(22) PCT Filed: Jun. 24, 2015

(86) PCT No.: PCT/CN2015/082254
§ 371 (c)(1),
(2) Date: Dec. 22, 2016

(87) PCT Pub. No.: WO2015/197002
PCT Pub. Date: Dec. 30, 2015

(65) Prior Publication Data

US 2017/0214193 A1 Jul. 27, 2017

(30) Foreign Application Priority Data

| | | |
|---|---|---|
| Jun. 24, 2014 | (CN) | 2014 2 0341035 |
| Sep. 19, 2014 | (CN) | 2014 2 0541444 |
| Sep. 30, 2014 | (CN) | 2014 2 0573999 |
| Nov. 14, 2014 | (CN) | 2014 2 0683978 |
| Nov. 28, 2014 | (CN) | 2014 2 0735406 |
| Dec. 31, 2014 | (CN) | 2014 2 0864997 |
| Feb. 17, 2015 | (CN) | 2015 2 0114091 |

(51) Int. Cl.

| | |
|---|---|
| ***H01R 13/658*** | (2011.01) |
| ***H01R 24/64*** | (2011.01) |
| ***H01R 13/6581*** | (2011.01) |
| ***H01R 13/6598*** | (2011.01) |

(Continued)

(52) U.S. Cl.
CPC ..... *H01R 13/65807* (2013.01); *H01R 13/506* (2013.01); *H01R 13/6581* (2013.01); *H01R 13/6598* (2013.01); *H01R 24/64* (2013.01); *H01R 2107/00* (2013.01)

(58) Field of Classification Search
CPC ..... H01R 13/65807
See application file for complete search history.

(56) References Cited

U.S. PATENT DOCUMENTS 9,214,766 B1 * 12/2015 Yu ..... H01R 13/6585
2010/0093216 A1 * 4/2010 Cohen ..... H01R 13/65807 439/607.31

(Continued)

*Primary Examiner* — James Harvey
(74) *Attorney, Agent, or Firm* — WPAT, PC

(57) ABSTRACT

An electric connector comprises: an insulated seat provided with a base seat and a tongue provided on one end of the base seat; two terminal sets disposed on the insulated seat and provided with two rows of terminals having contacts disposed on two connection surfaces of the tongue forming two symmetrical spaces, respectively; and a metal housing covering the insulated seat and resting and positioning against the base seat and formed with a connection slot. The connection slot can be inserted and positioned by an electric connector in a reversible dual-position manner. The insulated seat is provided with first and second seats mutually stacked and assembled together, and fixed to one terminal set, the tongue comprises first and second tongues of the first and second seats stacked and assembled together, and the outer edge of the tongue is in the form of an integrally formed full height.

29 Claims, 23 Drawing Sheets

(51) Int. Cl.
*H01R 13/506* (2006.01)
*H01R 107/00* (2006.01)

(56) References Cited

U.S. PATENT DOCUMENTS

2013/0196551 A1* 8/2013 Minich ..... H01R 13/42
439/660
2014/0364006 A1* 12/2014 Lo ..... H01R 13/6461
439/607.01
2015/0207283 A1* 7/2015 Guitard ..... H01R 13/6272
439/370
2017/0214193 A1* 7/2017 Tsai ..... H01R 24/64

* cited by examiner

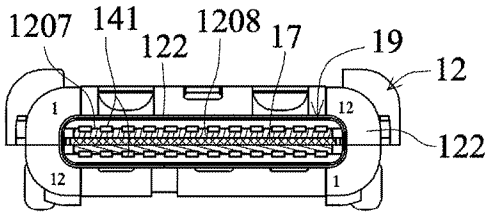
FIG. 6
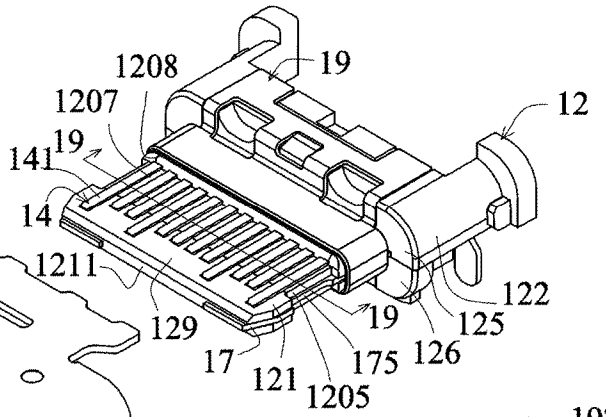
FIG. 5
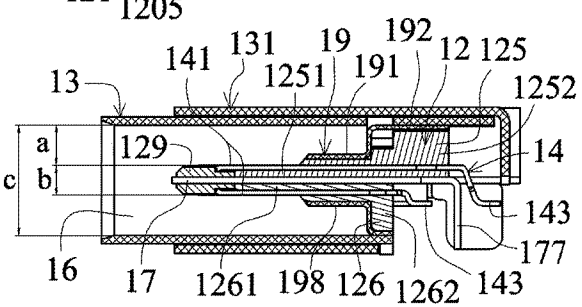
FIG. 7
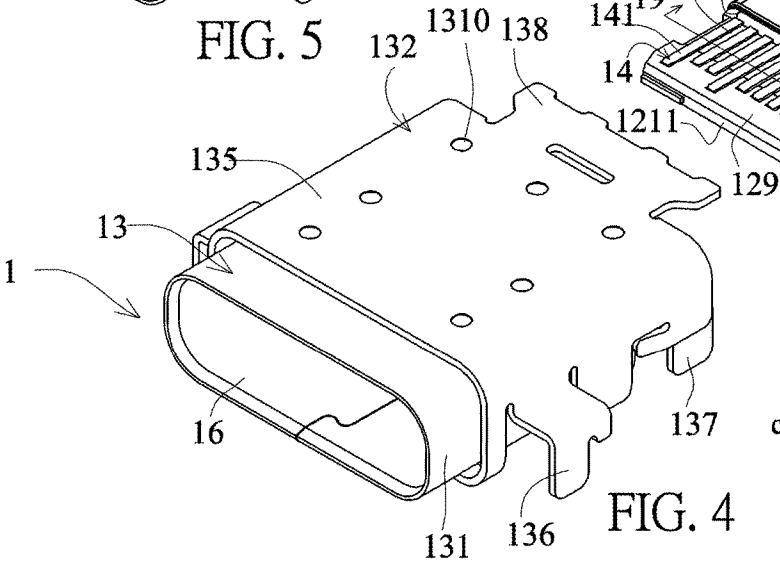
FIG. 4
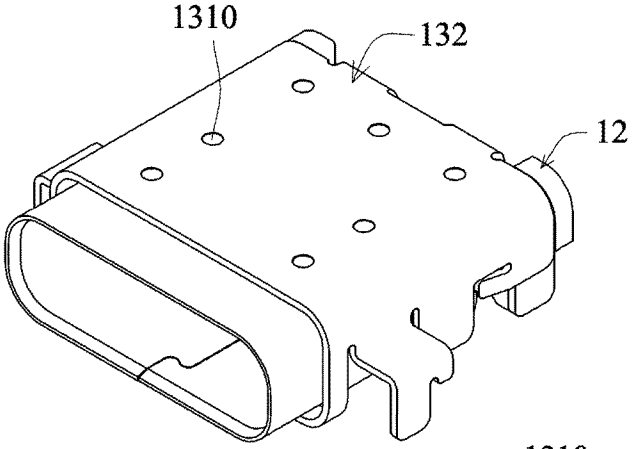

ELECTRIC CONNECTOR

BACKGROUND OF THE INVENTION

Field of the Invention

The invention relates to an electric connector, and more particularly to a reversible duplex electric connector.

Description of the Related Art

Referring to FIGS. 1 and 2, a conventional high-definition multimedia interface (HDMI) electric connector is provided with a plastic seat 91, two rows of terminals 92 and a metal housing 93, wherein the plastic seat 91 is integrally provided with a base seat 911 and a tongue 912, the tongue 912 projects beyond the front end of the base seat 911, the two rows of terminals 92 are embedded into the plastic seat 91, each of the two rows of terminals 92 is provided with an elastically non-movable contact 921 disposed on top and bottom surfaces of the tongue 912, respectively, and two rows of contacts 141 of the top and bottom surfaces of the tongue 912 respectively contain 10 and 9 contacts cross-interleaving in the left-to-right direction. The two rows of contacts 921 form the HDMI contact interface, the metal housing 93 covers the plastic seat 91, a front section inside the metal housing 93 is formed with a connection slot 95, the tongue 912 is horizontally disposed in the connection slot 95, and the shape of the connection slot 95 is asymmetrical in the top-to-bottom direction to provide the mistake-proof effect, so that the electrical connection can be made at one single position.

The conventional electrical connection socket cannot be easily manufactured because the two rows of terminals 92 are integrally embedded into the plastic seat 91. More particularly, when the specification becomes smaller, the manufacturing precision needs to be very high, and cannot be easily implemented.

Furthermore, the metal housing 93 is a four-sided housing bent from a metal plate sheet to have a seam to affect the shielding effect.

Furthermore, the conventional socket and plug are provided with internal ground shielding sheets electrically connected together. However, the conventional socket and plug are provided with two separate ground shielding sheets, so that the assembling becomes more inconvenient and the effect of strengthening the overall structure cannot be provided.

Referring to FIG. 3, which is a side cross-sectional view showing docking between a conventional biased MIRCO USB electrical connection plug 20 and a biased MIRCO USB electrical connection socket 90, the biased MIRCO USB electrical connection plug and the biased MIRCO USB electrical connection socket are the standard electrical connection plug and electrical connection socket having the minimum height specification specified by USB Association.

The biased MIRCO USB electrical connection socket 90 is provided with a plastic seat 91, one row of five terminals 92 and a metal housing 93, wherein the plastic seat 91 is integrally provided with a base seat 911 and a tongue 912, the tongue 912 projects beyond the front end of the base seat 911, the two rows of terminals 92 are embedded into the plastic seat 91, the one row of terminals 92 are provided with elastically non-movable contacts 921 respectively disposed on the bottom surface of the tongue 912, the metal housing 93 covers the plastic seat 91, a front section inside the metal housing 93 is formed with a connection slot 95, and the tongue 912 is horizontally disposed above an upper position of the connection slot 95, so that the connection slot 95 is formed with a small space 951 and a large space 952 on two opposite surfaces of the tongue 912.

The biased MIRCO USB electrical connection plug 20 is provided with an insulated seat 21, a metal housing 22 and one row of five terminals 23. The metal housing 22 covers the insulated seat 21. A connection portion of the standard electrical connection plug is provided with a fitting slot 24 fitting with the tongue 121 and a fitting interface substrate 25 fitting with the large space 952. The fitting interface substrate 25 has an outer layer being a metal housing and an inner layer being an insulated seat. The one row of five terminals 23 are provided with vertically elastically movable contacts 231, and the contact 231 projects beyond the inner surface of the fitting interface substrate 25 to the fitting slot 24.

A tongue 921 of the biased MICRO USB electrical connection socket 90 specified by USB Association has a height of 0.6 mm, the small space 161 has a height of 0.28 mm, the large space 162 has a height of 0.97 mm, and the connection slot 16 has a height of 1.85 mm.

A connection portion of the biased MICRO USB electrical connection plug 20 specified by USB Association has a height of 1.8 mm, the fitting slot 24 has a height of 0.65 mm, the metal housing 22 has a thickness of 0.25 mm, and the fitting interface substrate 25 has a height of 0.9 mm.

SUMMARY OF THE INVENTION

A main object of the invention is to provide an electric connector, wherein the insulated seat is provided with directly stacked first and second seats respectively fixedly embedded into and injected molded with a terminal set, so that the convenience in manufacturing can be achieved.

Another main object of the invention is to provide an electric connector, wherein an outer edge of the tongue is in the form of an integrally formed full height, so that the stacked first and second tongues can be positioned more firmly and has the exterior having the better perceptive structural strength.

Another main object of the invention is to provide an electric connector, wherein the tongue is provided with mutually stacked first and second tongues, the first and second tongues are provided with a resilient overpressure leaning against the jointing surface, so that when the first and second tongues are stacked together, the first and second tongues resiliently press against each other through the resilient overpressure leaning against the jointing surface to achieve the flat contact without curving.

Another main object of the invention is to provide an electric connector, a horizontally extending metal sheet is provided from the base seat of the insulated seat to the tongue, so that the mutual electric interference between the two rows of first terminals can be reduced and the high-speed transmission is facilitated.

Another main object of the invention is to provide an electric connector, wherein the multi-layer design of the dual-position low height socket can be achieved, and the space can be utilized more effectively.

In order to achieve above-mentioned objects, the invention provides an electric connector, comprising: an insulated seat comprising a base seat and a tongue, wherein one end of the base seat is projectingly provided with the tongue, an inner end of the tongue is connected to the base seat, an outer end of the tongue is a free end, plate surfaces of two larger areas of the tongue are two connection surfaces, and the other two opposite edges of the tongue facing inner and outer ends are two sides; two terminal sets disposed on the insulated seat, wherein each of the terminal sets is provided with at least one row of terminals, one end of each of the terminals is extended and provided with a contact and the other end of each of the terminals is extended and provided with a pin, and the contacts of the two terminal sets are respectively disposed on the two connection surfaces of the tongue, respectively; and a metal housing covering the insulated seat and resting and positioning against the base seat, wherein the metal housing is formed with a connection slot, the tongue is disposed at a middle height of the connection slot, the two connection surfaces of the tongue form two symmetrical spaces, and the connection slot can be inserted and positioned by an electric connector in a reversible dual-position manner; characterized in that the insulated seat is provided with a first seat and a second seat mutually stacked and assembled together, the first and second seats are fixed to one of the terminal sets, the first seat is integrally formed with a first base seat and a first tongue, the second seat is integrally formed with a second base seat and a second tongue, the first and second base seats are stacked to form the base seat, the tongue comprises the first and second tongues stacked and assembled together, and an outer edge of the tongue is in the form of an integrally formed full height.

In the reversible duplex electric connector, heights of the two symmetrical spaces are larger than a small space of a connection slot of a biased electrical connection socket having a minimum height specification specified by USB Association and smaller than a large space of the connection slot of the biased electrical connection socket, wherein the biased electrical connection socket comprises a connection slot, and a tongue is disposed in the connection slot in a vertically biased manner, wherein two corresponding surfaces of the tongue form the large space and the small space, and one surface of the tongue facing the large space is provided with one set of contacts.

The electric connector is further provided with two ground shielding sheets of a metal material, the two ground shielding sheets are positioned at the insulated seat and contact the metal housing, and the two ground shielding sheets are provided with two first plate sheets respectively covering inner sections of the two connection surfaces of the tongue.

In the electric connector, the two ground shielding sheets are integrally connected together to from a ground shielding member, at least one ground shielding sheet is provided with a second plate sheet forming a step together with the first plate sheet, and the second plate sheet covers the base seat and is electrically connected to the metal housing.

In the electric connector, the ground shielding member is provided with a four-sided housing, and the four-sided housing is fitted with and positioned at the insulated seat.

The electric connector is one of (a) to (g) or a combination of more than one of (a) to (g):

(a) wherein the four-sided housing is formed with the first plate sheet having the two ground shielding sheets, and the four-sided housing is fitted with and positioned at the inner section of the tongue;

(b) wherein the four-sided housing is formed with the first plate sheet having the two ground shielding sheets, the four-sided housing is fitted with and positioned at the inner section of the tongue, a middle of the insulated seat is provided with a metal partition plate, the metal partition plate extends from the base seat to the tongue to separate the contacts of the two terminal sets, two sides of the metal partition plate are provided with laterally projecting convex portions, and two side plates of the four-sided housing contact the convex portions of the two sides of the metal partition plate;

(c) wherein both of the two ground shielding sheets are provided with the second plate sheets, the four-sided housing is formed with the second plate sheet having the two ground shielding sheets, and the four-sided housing is fitted with and positioned at the base seat;

(d) wherein both of the two ground shielding sheets are provided with the second plate sheets;

(e) wherein the ground shielding member is formed by bending a metal plate sheet, and the four-sided housing is combined and engaged together on a plate surface;

(f) wherein the four-sided housing of the ground shielding member has no seam; and (g) wherein the tongue has a thickness of the inner section is thicker than an outer section so that the inner sections of the two connection surfaces project much more than the outer sections of the two connection surfaces.

In the electric connector, the first and second tongues are provided with tongue snapping structures mutually engaged with each other, and the tongue snapping structure has snapping structures mutually limiting and engaging with each other in a direction perpendicular to the two connection surfaces of the tongue.

In the electric connector, the first and second base seats are provided with base seat snapping structures mutually engaged with each other, and the base seat snapping structure has snapping structures mutually limiting and engaging with each other in a direction perpendicular to the two connection surfaces of the tongue.

The electric connector is one of (a) to (i) or a combination of more than one of (a) to (i):

(a) wherein an external shape of the connection slot is top-bottom symmetrical and left-right symmetrical, the tongue is disposed at the middle height of the connection slot, and the two connection surfaces of the tongue form two symmetrical spaces;

(b) wherein a thickness of the base seat is larger than that of the tongue;

(c) wherein the contacts of the two terminal sets are in flat surface contact with the connection surfaces of the tongue and are not elastically movable;

(d) wherein the contacts of the two terminal sets are respectively fixed to the two connection surfaces of the tongue in a flat surface contact manner and are not elastically movable, the contacts of the two terminal sets are in the forms of two rows of different lengths, and the lengths of the contacts of the two terminal sets are correspondingly arranged reversely;

(e) wherein each of the two terminal sets is one row of 12 terminals having the contacts, which are not elastically movable;

(f) wherein the two connection surfaces of the tongue horizontally extend frontwards, an inlet of the connection slot faces frontwards, and the outer end of the tongue is a front end of the tongue; or wherein the two connection surfaces of the tongue extend vertically upwards, and the inlet of the connection slot faces upwards; or wherein the two connection surfaces of the tongue stand vertically and extend frontwards, and the inlet of the connection slot faces frontwards;

(g) wherein the contacts of the two terminal sets are vertically aligned;

(h) wherein the contacts of the two terminal sets are arranged in an equally spaced manner; and (i) wherein the first and second seats are respectively embedded into and injection molded with a terminal set.

The electric connector is one of (a) to (g) or a combination of more than one of (a) to (g):

(a) wherein snapping surfaces of the tongue snapping structures snapping together are horizontal surfaces;

(b) wherein each of the at least two terminal sets are arranged in one row, and the contacts of the two rows of terminals are vertically aligned;

(c) wherein one of outer ends of the first and second tongues is provided with at least one engaging slot, the other of the outer ends of the first and second tongues is provided with at least one snapping convex portion fitted into and snapped to the one row of engaging slots, and the tongue snapping structure is the at least one snapping convex portion snapping to the at least one engaging slot;

(d) wherein one of outer ends of the first and second tongues is provided with at least one engaging slot, the other of the outer ends of the first and second tongues is provided with at least one snapping convex portion fitted into and snapped to the one row of engaging slots, the at least one snapping convex portion of the other one is formed by a distal end of at least one terminal formed thereon, and the tongue snapping structure is the at least one snapping convex portion snapping to the at least one engaging slot;

(e) wherein the tongue snapping structure is disposed on the outer ends of the first and second tongues;

(f) wherein each of two sides of the first base seat is provided with a lateral arm connected to two sides of the second base seat; and (g) wherein the contacts of the two terminal sets are not elastically movable and have different lengths, the lengths of the contacts of the two terminal sets are correspondingly arranged reversely, the distal end of the terminal of the shorter contact of the second tongue is convex upwards and provided with the snapping convex portion projecting beyond a front end of the second tongue, the distal end of the terminal of the longer contact horizontally projects beyond the front end of the second tongue, a front end of the first tongue projects downwards and is provided with one row of engaging slots, a bottom of the front end of the first tongue is flush with a bottom of the second tongue and provided with at least one space providing slots to be connected to the terminal of the longer contact of the second tongue, the snapping convex portion of the distal end of the terminal of the shorter contact of the second tongue is fitted into and snapping to the one row of engaging slots from rear to front, and the tongue snapping structure is the one row of snapping convex portions snapping to the one row of engaging slots.

The electric connector is one of (a) to (d) or a combination of more than one of (a) to (d):

(a) wherein the ground shielding sheet is provided with a second plate sheet forming a step together with the first plate sheet, and the second plate sheet covers the base seat and is electrically connected to the metal housing;

(b) wherein the ground shielding sheet is provided with a second plate sheet forming a step together with the first plate sheet, the second plate sheet covers the base seat and is electrically connected to the metal housing, a vertical sheet is present between the first and second plate sheets and each of two sides is projectingly provided with an engaging portion, and the engaging portion is engaged with the base seat;

(c) wherein the ground shielding sheet is provided with a second plate sheet forming a step together with the first plate sheet, the second plate sheet covers the base seat and is electrically connected to the metal housing, a vertical sheet is present between the first and second plate sheets, the first plate sheet is further connected to another vertical sheet, and the two vertical sheets are correspondingly connected to the first plate sheet and in the form of a U-shaped body engaged with the base seat; and (d) wherein the ground shielding sheet is provided with a second plate sheet forming a step together with the first plate sheet, the second plate sheet covers the base seat and is electrically connected to the metal housing, and each of two sides of the first plate sheet is provided with an engaging portion perpendicularly engaged with the tongue.

In the electric connector, a metal partition plate is positioned and provided between the first and second seats, and the metal partition plate extends from the base seat to the tongue.

The electric connector is one of (a) to (d) or a combination of more than one of (a) to (d):

(a) wherein each of two sides of the outer section of the metal partition plate is provided with an engaging slot, each of two sides of the first and second tongues is provided with a slot corresponding to the engaging slot; or wherein each of two sides of the outer section of the metal partition plate is provided with an engaging slot, and each of two sides of the first and second tongues is provided with a slot corresponding to the engaging slot, and the metal partition plate has a sufficient structural strength in a length range of the engaging slot and approaches a complete plate surface;

(b) wherein a front edge of the metal partition plate and the first tongue rest and limit against each other, a rear edge of the metal partition plate and the second base seat rest and limit against each other, and the metal partition plate is snapped to the first tongue from rear to front;

(c) wherein the metal partition plate is provided with at least one pin extending to an outside of the insulated seat; and (d) wherein a plate surface of the metal partition plate is provided with at least one longitudinal opening in a front-rear direction, an inner surface of the first tongue is provided with an engagement block, which can be fit with and slide relative to the longitudinal opening, and when the metal partition plate moves frontwards, a rear edge of the longitudinal opening and a rear edge of the engagement block may rest and limit each other.

In the reversible duplex electric connector, the tongue comprises an outer tongue seat, the outer tongue seat is combined and engaged with outer ends of the first and second tongues to form the tongue, and the outer end of the outer tongue seat forms the outer edge of the tongue.

The reversible duplex electric connector is one of (a) to (g) or a combination of more than one of (a) to (g):

(a) wherein two connection surfaces of the outer tongue seat are provided with depressed portions for providing spaces for the terminal sets of the first and second tongues;

(b) wherein a metal partition plate is provided between the first and second seats, and the metal partition plate extends from the base seat to the tongue and has one end snapped and fixed to the outer tongue seat;

(c) wherein a metal partition plate is provided between the first and second seats, and the metal partition plate extends from the base seat to the tongue and has one end embedded and fixed into the outer tongue seat;

(d) wherein a metal partition plate is provided between the first and second seats, the metal partition plate extends from the base seat to the tongue and has two sides each provided with an engaging slot, and two sides of a combination of the first and second tongues and an outer seat of the tongue form slots corresponding to the engaging slots of the metal partition plate;

(e) wherein the outer tongue seat is provided with separate engagement holes, each of the outer ends of the first and second tongues is projectingly provided with snapping convex portions, and the snapping convex portions of the first and second tongues correspondingly engage with the engagement holes of the outer tongue seat;

(f) wherein the outer tongue seat is provided with separate engagement holes, each of the outer ends of the first and second tongues is projectingly provided with snapping convex portions, the snapping convex portions of the first and second tongues correspondingly engage with the engagement holes of the outer tongue seat, and the snapping convex portions of the first and second tongues are formed by end sections of the terminals thereon; and (g) wherein the outer tongue seat is provided with separate engagement holes, each of the outer ends of the first and second tongues is projectingly provided with snapping convex portions, the snapping convex portions of the first and second tongues correspondingly engage with the engagement holes of the outer tongue seat, the snapping convex portions of the first and second tongues are staggered and disposed at a middle thickness of the tongue and arranged in one row, and the engagement holes of the outer tongue seat are arranged in one row.

In the electric connector, the tongue comprises an outer tongue seat, one end of the metal partition plate is fixed to the outer tongue seat, each of two connection surfaces of the outer tongue seat is provided with one row of depressed portions, end sections of the terminals of the terminal sets of the first and second tongues project beyond the outer ends of the first and second tongues and are connected to the row of depressed portions of the two connection surfaces of the outer tongue seat, and the outer end of the outer tongue seat forms the outer edge of the tongue.

The electric connector is one of (a) to (g) or a combination of more than one of (a) to (g):

(a) wherein the contacts of the terminal sets of the first and second tongues are not elastically movable;

(b) wherein the contacts of the terminal sets of the first and second tongues are not elastically movable and are in flat surface contact with and connected to the row of depressed portions of the two connection surfaces of the outer tongue seat;

(c) wherein the contacts of the terminal sets of the first and second tongues are not elastically movable and distal ends of the terminals are slightly bent toward the row of depressed portions of the two connection surfaces of the outer tongue seat, and are lower than the connection surface;

(d) wherein each of two sides of the metal partition plate is provided with an engaging slot, and two sides of a combination of the first and second tongues and an outer seat of the tongue form slots corresponding to the engaging slots of the metal partition plate;

(e) wherein the outer ends of the first and second tongues rest against the outer tongue seat;

(f) wherein the first and second seats and the metal partition plate are limited and engaged with each other except for in a direction perpendicular to the two connection surfaces of the tongue; and (g) wherein the first tongue of the first seat and the second tongue of the second seat are such that an inner section is thicker than an outer section to make the inner sections of the two connection surfaces project beyond the outer sections of the two connection surfaces, and the contacts of the two terminal sets are not elastically movable and exposed and fixed to the outer sections of the first and second tongues in a flat surface contact manner.

In the electric connector, end sections of the terminals of the terminal sets of the first and second tongues have a resilient overpressure leaning against the outer tongue seat and connected to one row of depressed portions of the two connection surfaces of the outer tongue seat, so that after the overall parts are assembled, and the upper and lower tongues can tightly clamp the metal partition plate by the resilient overpressure of the two rows of terminals leaning against the outer tongue seat.

In the reversible duplex electric connector, the outer edge of the tongue is integrally formed with one of the first and second tongues.

In the reversible duplex electric connector, the first tongue is provided with the outer edge of the tongue, a front section of the first tongue has a thicker convex surface, the convex surface is provided with space providing slots, and the space providing slots can be connected to outer sections of the terminals on the second tongue.

In the reversible duplex electric connector, the first and second tongues are provided with a resilient overpressure leaning against a jointing surface, so that when the first and second tongues are stacked together, the first and second tongues resiliently press against each other through the resilient overpressure leaning against the jointing surface.

The invention further provides an electrical connection socket, comprising: an insulated seat provided with a base seat and a tongue, wherein one end of the base seat is projectingly provided with the tongue, an inner end of the tongue is connected to the base seat, and the tongue is provided with two connection surfaces with larger plate surfaces; two terminal sets disposed on the insulated seat, wherein each of the terminal sets is provided with at least one row of terminals, one end of each of the terminals is extended and provided with a contact and the other end of each of the terminals is extended and provided with a pin extending out of the base seat, and the contacts of the two terminal sets are respectively exposed from the two connection surfaces of the tongue; and a metal housing covering the insulated seat and provided with a four-sided primary housing, wherein the four-sided primary housing is formed with a connection slot, the tongue is disposed in the connection slot, an outer end of the tongue approaches an insert port of the connection slot, and the connection slot can be electrically connected to an inserted docking electrical connection plug; characterized in that the insulated seat is provided with a first seat and a second seat stacked together, the two terminal sets are respectively embedded into and injection molded with the first and second seats, the first seat is integrally formed with a first base seat and a first tongue, the second seat is integrally formed with a second base seat and a second tongue, the first and second base seats are stacked to form the base seat, the tongue comprises the stacked first and second tongues, the first and second base seats are stacked to form the base seat, and the first and second tongues are provided with a resilient overpressure leaning against a jointing surface, so that when the first and second tongues are stacked together, the first and second tongues resiliently press against each other through the resilient overpressure leaning against the jointing surface.

The invention further provides an electric connector, comprising: an insulated seat provided with a base seat and a tongue, wherein one end of the base seat is projectingly provided with the tongue, an inner end of the tongue is connected to the base seat, an outer end of the tongue is a free end, and plate surfaces of two larger areas of the tongue are two connection surfaces; two terminal sets disposed on the insulated seat, wherein each of the terminal sets is provided with at least one row of terminals, one end of each of the terminals is extended and provided with a contact and the other end of each of the terminals is extended and provided with a pin, and the contacts of the two terminal sets are respectively disposed on the two connection surfaces of the tongue, respectively; and a metal housing covering the insulated seat and resting and positioning against the base seat, wherein the housing is formed with a connection slot, the tongue is disposed at a middle height of the connection slot, the two connection surfaces of the tongue form two symmetrical spaces, and the connection slot can be inserted and positioned by an electric connector in a reversible dual-position manner; characterized in that a middle of the insulated seat is provided with a metal partition plate, the metal partition plate extends from the base seat to the tongue and separates the two terminal sets, heights of the two symmetrical spaces are larger than the small space of the connection slot of the biased electrical connection socket of the minimum height specification specified by USB Association according to claim 2, and smaller than the large space of the connection slot of the biased electrical connection socket.

The invention further provides a multi-layer electric connector, comprising: a first connector provided with a connection slot, wherein a tongue is provided at a middle height of the connection slot, plate surfaces of two larger areas of the tongue are two connection surfaces, each of the two connection surfaces is provided with a contact interface, the connection slot forms two symmetrical spaces on the two connection surfaces of the tongue, and the connection slot can be inserted and positioned by an electric connector in a reversible dual-position manner; and a second connector provided with a connection slot, wherein at least one contact interface is provided in the connection slot, and the connection slot of the second connector and the connection slot of the first connector are arranged vertically in a multi-layer manner; characterized in that two symmetrical spaces of the connection slot of the first connector on two connection surfaces of the tongue are larger than the small space of the connection slot of the biased electrical connection socket of the minimum height specification specified by USB Association according to claim 2, and smaller than the large space of the connection slot of the biased electrical connection socket.

The electric connector is one of (a) to (c) or a combination of more than one of (a) to (c):

(a) wherein two contact interfaces of the first connector are respectively formed by contacts of terminals of a terminal set, and the contacts of the terminal sets of the two tongues are not elastically movable;

(b) wherein two contact interfaces of the first connector are respectively formed by contacts of terminals of a terminal set, and the contacts of the terminals of the two terminal sets are not elastically movable and are in flat surface contact with the two connection surfaces; and (c) wherein the connection slot of the second connector and the connection slot of the first connector are formed by one metal housing.

The invention has the following advantages.

1. The insulated seat is provided with stacked first seat and second seat, which are respectively embedded into and injection molded with at least one terminal set so that the simplified manufacturing can be achieved.

2. The outer edge of the tongue is in the form of an integrally formed full height, so that the stacked first and second tongues can be positioned more firmly and has the exterior having the better perceptive structural strength.

3. The two symmetrical spaces of two connection surfaces of the tongue in the connection slot have a height of low-height design to achieve the slim and light effects.

4. The tongue is provided with mutually stacked first and second tongues, and the first and second tongues are provided with the resilient overpressure leaning against the jointing surface, so that when the first and second tongues are stacked together, the first and second tongues resiliently press against each other through the resilient overpressure leaning against the jointing surface to achieve the flat contact without curving.

5. A horizontally extending metal sheet is provided from the base seat of the insulated seat to the tongue, so that the mutual electric interference between the two rows of first terminals can be reduced and the high-speed transmission is facilitated.

6. The multi-layer design of the dual-position low height socket can be achieved, and the space can be utilized more effectively.

The above-mentioned and other objects, advantages and features of the invention will become more fully understood from the detailed description of the preferred embodiments given hereinbelow and the accompanying drawings.

BRIEF DESCRIPTION OF THE DRAWINGS

FIG. 4 is a pictorially exploded view according to the first embodiment of the invention.

FIG. 5 is a pictorially assembled view according to the first embodiment of the invention.

FIG. 6 is a front view according to the first embodiment of the invention (when the metal housing is not assembled).

FIG. 7 is a side cross-sectional view according to the first embodiment of the invention.

DETAILED DESCRIPTION OF THE INVENTION

Figure 1:
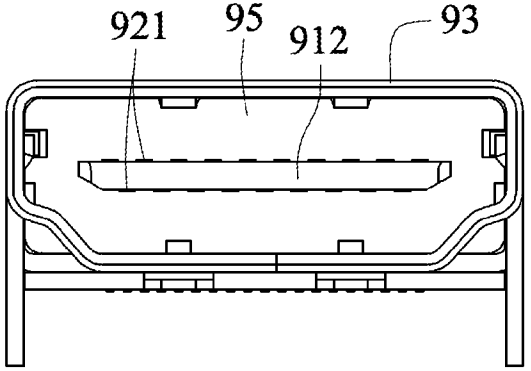
FIG. 1(Prior Art)
FIG. 1 is a front view showing a conventional electric connector.
Figure 2:
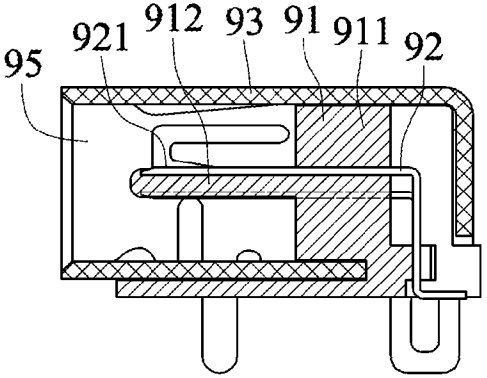
FIG. 2(Prior Art)
FIG. 2 is a side cross-sectional view showing the conventional electric connector.
Figure 3:
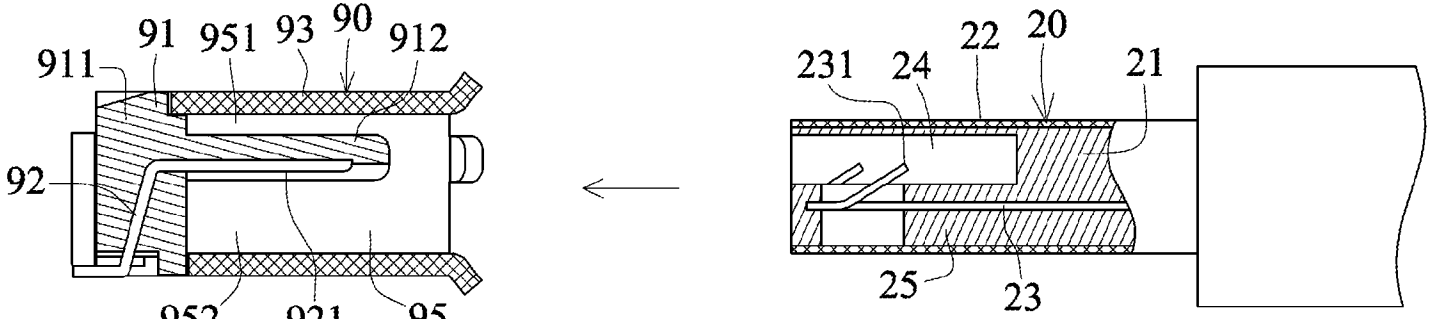
FIG. 3(Prior Art)
FIG. 3 is an exploded side cross-sectional view showing docking between the conventional electrical connection plug and the electrical connection socket.
Figure 9:
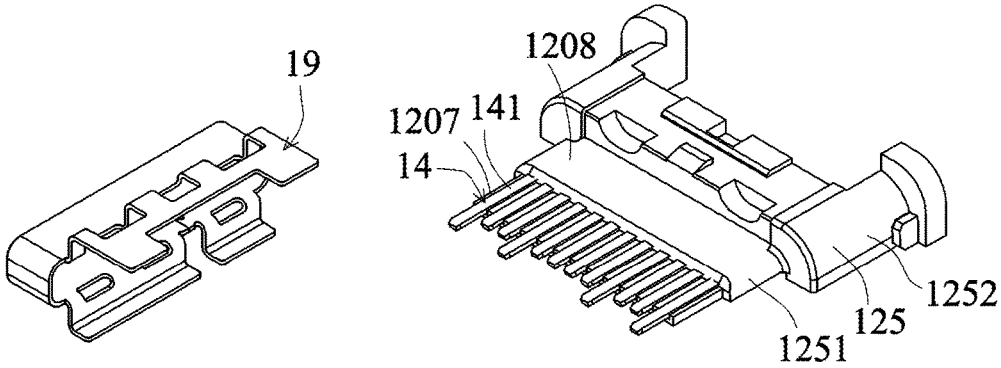
FIG. 9 is a pictorial view showing a ground shielding member according to the first embodiment of the invention.
Figure 8:
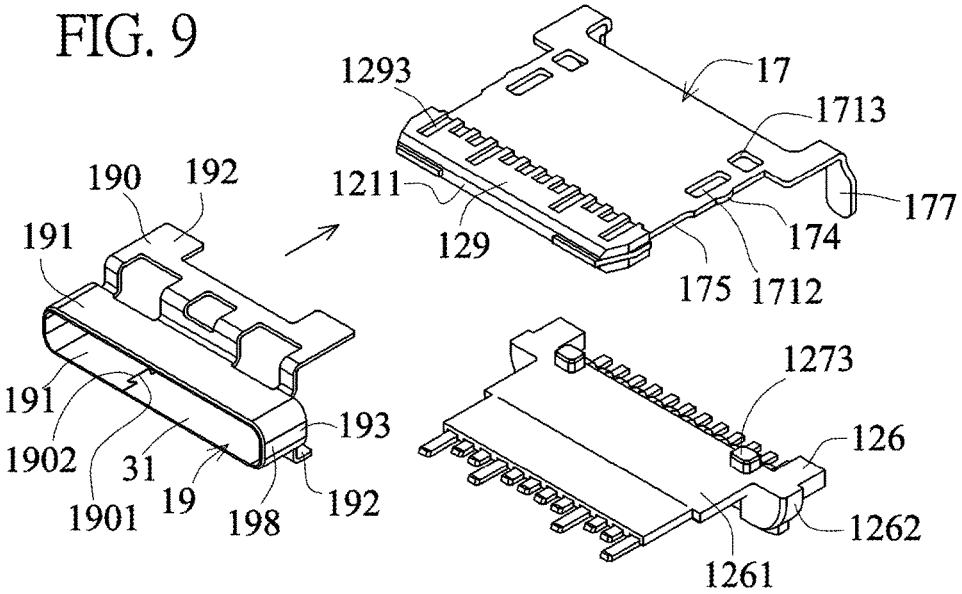
FIG. 8 is a pictorially exploded view showing an insulated seat, a metal partition plate and a ground shielding member according to the first embodiment of the invention.

Referring to FIGS. 4 to 12, a dual-position duplex USB TYPE-C electrical connection socket 1 of a plate-depressed type according to this embodiment is provided with an insulated seat 12, two terminal sets, a ground shielding member 19, a metal partition plate 17, a metal housing 13 and a second metal shell 132.

Figure 10:
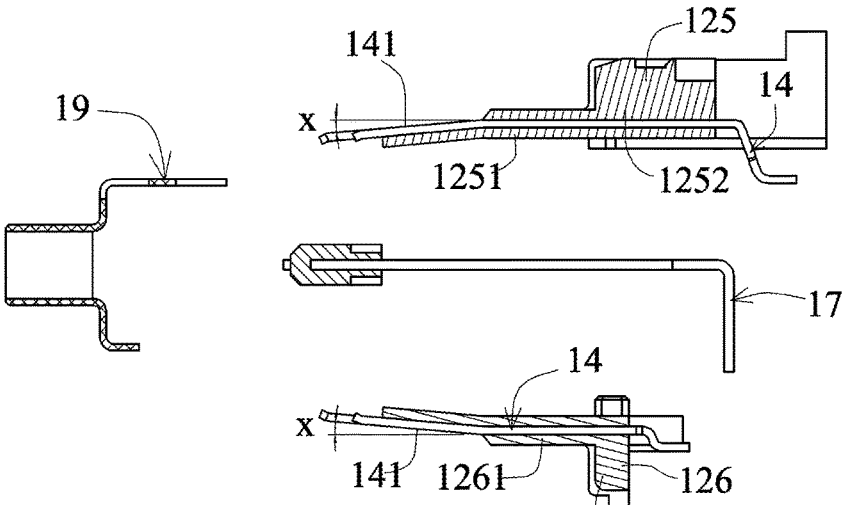
FIG. 10 is a exploded side view showing the insulated seat, the metal partition plate and the ground shielding member according to the first embodiment of the invention.
Figure 12:
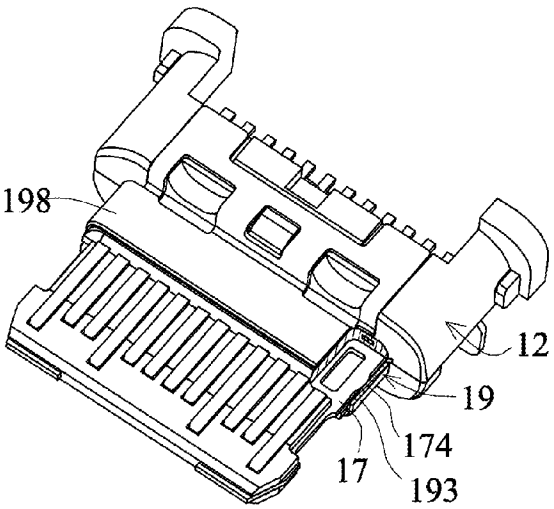
FIG. 12 is a pictorially assembled view showing the insulated seat, the ground shielding member and the metal partition plate according to the first embodiment of the invention.
Figure 11:
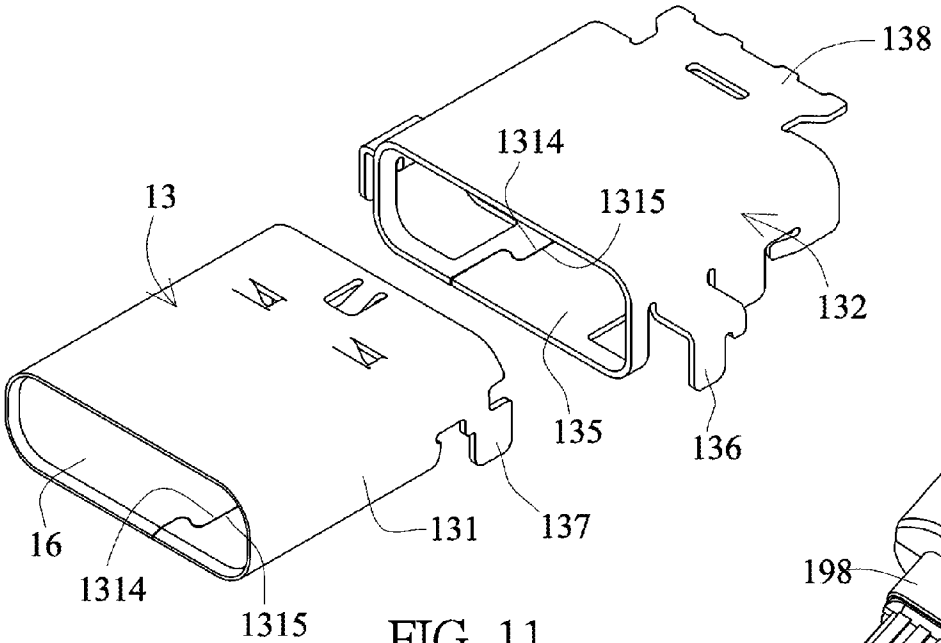
FIG. 11 is a pictorially exploded view showing the metal housing and the second metal shell according to the first embodiment of the invention.

The insulated seat 12 is a plastic material and provided with a base seat 122 and a tongue 121. A front end of the base seat 122 is projectingly provided with the tongue 121. An inner end of the tongue 121 is connected to the base seat 122. The thickness of the base seat 122 is larger than that of the tongue 121. Top and bottom surfaces of the tongue 121 are two connection surfaces having larger plate surfaces. The thickness of the tongue 121 is such that the inner section is thicker than the outer section so that inner sections 1208 of the two connection surfaces project much more than outer sections 1207 of the two connection surfaces. The insulated seat 12 is provided with a first seat 125, a second seat 126 and an outer tongue seat 129. The first and second seats 125 and 126 are vertically stacked. The first seat 125 is integrally formed with a first tongue 1251 and a first base seat 1252, and the second seat 126 is integrally formed with a second tongue 1261 and a second base seat 1262. The tongue 121 comprises the stacked first and second tongues 1251 and 1261 and the outer tongue seat 129, and an outer edge 1211 of the tongue is in the form of an integrally formed full height. The first tongue 1251 of the first seat and the second tongue 1261 of the second seat are such that the inner section is thicker than the outer section so that the inner sections 1208 of the two connection surfaces project much more than the outer sections 1207 of the two connection surfaces. The outer tongue seat 129 is connected to the outer ends of the first and second tongues 1251 and 1261. An outer end of the outer tongue seat 129 is the outer edge 1211 of the tongue. The first and second base seats 1252 and 1262 are stacked to form the base seat 122. The first and second tongues 1251 and 1261 are provided with the resilient overpressure leaning against the jointing surface. As shown in FIG. 10, the outer sections of the first and second tongues 1251 and 1261 are inclined toward the jointing surface by an angle X, so that when the first and second tongues 1251 and 1261 are stacked, the first and second tongues 1251 and 1261 resiliently press against and tightly contact with each other through the resilient overpressure leaning against the jointing surface.

Each of the two terminal sets has one row of 12 first terminals 14, and the two terminal sets are respectively embedded into and injection molded with the first and second seats 125 and 126. One end of each first terminal 14 is extended and provided with a contact 141 and the other end of each first terminal 14 is extended and provided with a pin 143 extending out of a rear end of the base seat 122. First surfaces of the contacts 141 of the two terminal sets are respectively exposed from the outer sections 1207 of the two connection surfaces of the tongue 121, and second surfaces of the contacts 141 are embedded into the tongue 121 and fixed in a flat surface contact manner. So, the inner sections of the contacts 141 of the two terminal sets are exposed and fixed to the outer sections of the first and second tongues in the flat surface contact manner, and the outer section of the contact 141 is in flat surface contact with and snapped to the outer tongue seat 129. So, the contact 141 is not elastically movable. However, the contacts 141 of the two terminal sets extend in the lengths the same as those of the first and second tongues 1251 and 1261, and are provided with the resilient overpressure leaning against the jointing surface. The contacts 141 of the two terminal sets are the same contact interface and vertically aligned. The contacts of the two terminal sets are arranged in an equally spaced manner. The circuit serial numbers of the connection points of the two contact interfaces are arranged reversely. As shown in FIG. 6, the upper row of contacts 141 have the connection points with the circuit serial numbers of 1 to 12 from left to right, and the lower row of contacts 141 have the connection points with the circuit serial numbers of 1 to 12 from right to left. In addition, the contacts 141 of the two terminal sets are in the forms of two rows of different lengths, that is, four longer ones and eight shorter ones.

The metal housing 13 covers the insulated seat 12 and rests against and engages with the base seat 122. The metal housing 13 is formed by bending a metal plate sheet, a front section thereof is provided with a four-sided primary housing 131, two sides of the rear end thereof are provided with two left-right symmetrical second plate connecting members 137. The four-sided primary housing 131 and the front end of the base seat 122 form a connection slot 16. The tongue 121 is horizontally suspended over the middle height of the connection slot 16 and extends frontwards. An insert port of the connection slot 16 faces frontwards. The connection slot 16 and the tongue 121 form a docking structure, so that an electrical connection plug can be reversibly inserted and electrically connected thereto at two positions for positioning. An outer end of the tongue 121 approaches the insert port of the connection slot 16. The two connection surfaces of the tongue 121 form symmetrical spaces. The shape of the connection slot 16 is top-bottom symmetrical and left-right symmetrical and has two arced sides close to a rectangle.

Referring to FIG. 7, the heights "a" of two symmetrical spaces of the two connection surfaces of the tongue 121 inside the connection slot 16 are about 0.93 mm, the height "b" of the outer section of the tongue is about 0.7 mm, the total height "c" of the connection slot 16 is about 2.56 mm, and the heights "a" of the two symmetrical spaces are larger than the small space (0.28 mm) of the connection slot of the biased electrical connection socket having the minimum height specification specified by USB Association and smaller than the large space (0.97 mm).

The second metal shell 132 is formed by bending a metal plate sheet and provided with a four-sided housing 135. The four-sided housing 135 is integrally outwardly projectingly provided with two left-right symmetrical first plate connecting members 136. The two first plate connecting members 136 are formed by prodding, pressing and bending the plate surface of the four-sided housing 135. The plate surface of the four-sided housing 135 is formed with a prodding hole or holes. To end sections of the first and second plate connecting members 136 and 137 are vertical and can be inserted, connected and positioned into a circuit board. The rear end of the second housing 132 is provided with a rear plate 138. The four-sided primary housing 131 and the four-sided housing 135 are combined and engaged together on a plate surface, that is, the connected two sides are provided with a dove-tail shaped engaging sheet 1314 and an engaging slot 1315 combined and engaged with each other, wherein the seams of both of them are staggered in the left-right direction for the mutual shielding.

The metal housing 13 and the second metal shell 132 are formed by bending the metal plate sheets having the same thickness, so both have the same structural strength and can support each other, and the seams of both of them are staggered in the left-right direction. Because both of them have the same structural strength, both of them have the averaged endurance, and the overall product needs not to be discarded due to the damage of one single part.

In addition, the connected two sides of the four-sided primary housing 131 may also be applied with laser welding for hot melting and combining so that the combination portion forms the seamless combination.

The four-sided housing 135 of the second metal shell 132 is tightly fitted with the outside of the four-sided primary housing 131 of the first housing from rear to front, and the two first plate connecting members 136 are disposed in front of the two second plate connecting members 137.

Spot welding may further be performed on the upper jointing portion between the metal housing 13 and the second metal shell 132 of this embodiment. As shown in FIG. 5, two rows of welding points 1310 are formed, because the first and second housings 51 and 52 are fitted and positioned with each other, the spot welding machining can be easily operated.

The metal partition plate 17 is fixedly disposed between the first and second seats 125 and 126, the metal partition plate 17 extends from the base seat 122 to the tongue 121 to separate the contacts 141 of the two terminal sets. The outer tongue seat 129 is embedded into, combined with and fixed to the outer end (front end) of the metal partition plate 17. The two connection surfaces of the outer tongue seat 129 are provided with depressed portions 1293. The outer ends of the contacts 141 of the two terminal sets are connected to the depressed portions 1293 of the two connection surfaces. Two sides of the metal partition plate 17 are provided with depressed engaging slots 175. Two sides of the tongue 121 are provided with concave portions 1205 corresponding to the engaging slots 175 of the metal partition plate 17 (see FIG. 4). The rear of each of the slots 175 of the two sides of the metal partition plate 17 is provided with a laterally projecting convex portion 174. The plate surfaces of the two sides of the metal partition plate 17 are provided with two longitudinal holes 1712 and two engagement holes 1713, and each of two sides of the rear end thereof extends downwards to form a pin 177. The two longitudinal holes 1712 can make the two convex portions 174 form the laterally elastically movable structure. The two engagement holes 1713 engage with two engagement blocks 1273 on the connection surface of the second seat 126.

The ground shielding member 19 is formed by bending a metal plate sheet, and is integrally provided with two ground shielding sheets 190. Each of the two ground shielding sheets 190 is provided with a first plate sheet 191 and a second plate sheet 192 with a step formed therebetween. The two first plate sheets 191 cover the inner sections 1208 of the two connection surfaces of the tongue 121. The two second plate sheets 192 cover top and bottom surfaces of the base seat 122 and are electrically connected to the metal housing 13. The two sides of the two first plate sheets 192 are integrally connected together through two side sheets 193. The two first plate sheets 191 and the two side sheets 193 form a four-sided housing 198. The four-sided housing 198 is combined and engaged together on a plate surface. That is, the connected two sides are provided with a dove-tail shaped engaging sheet 1901 and an engaging slot 1902 combined and engaged with each other. The four-sided housing 198 is fitted with and positioned at the inner section 122 of the two connection surfaces of the tongue 12 to fit and position the vertically stacked first and second tongues 1251 and 1261 and to strengthen the combination force between the first and second tongues 1251 and 1261. The two side sheets 193 of the four-sided housing 198 and the convex portion 174 of the two sides of the metal partition plate 17 resiliently contact together (see FIG. 12), so that the metal partition plate 17 and the metal housing 13 form the electrical connection and the better electric effect can be obtained.

Upon assembling, as shown in FIG. 4, the metal housing 13 and the second metal shell 132 are firstly fitted and positioned together, the insulated seat 12, and the ground shielding member 19 and the metal partition plate 17 are assembled and then assembled into the metal housing 13 from rear to front. Then, the rear plate 138 of the second metal shell 132 is bent to shield the rear end of the insulated seat 12.

Figure 13:
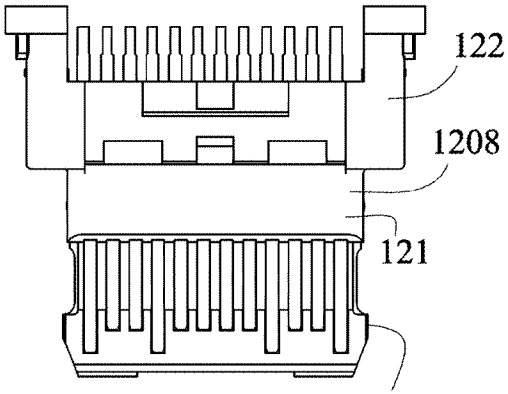
FIG. 13 is an assembled top view showing the insulated seat, the ground shielding member and the metal partition plate according to the first embodiment of the invention.
Figure 14:
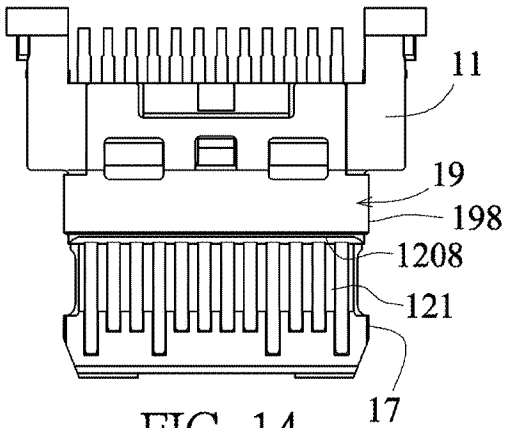
FIG. 14 is an assembled top view showing the insulated seat, the ground shielding member and the metal partition plate according to the first embodiment of the invention.
Figure 15:
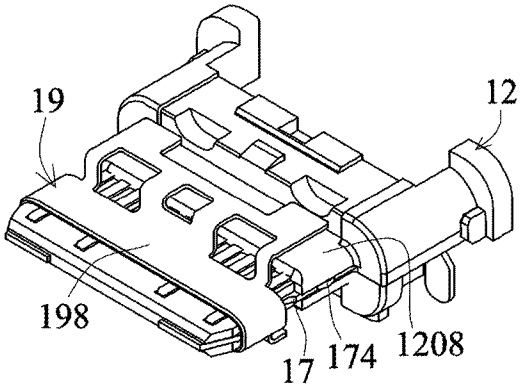
FIG. 15 is a pictorial view when the ground shielding member and the insulated seat according to the first embodiment of the invention are not assembled to the predetermined position.
Figure 16:
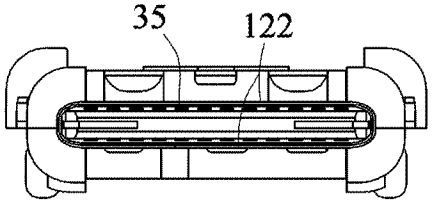
FIG. 16 is a front view when the ground shielding member and the insulated seat according to the first embodiment of the invention are not assembled to the predetermined position.
Figure 17:
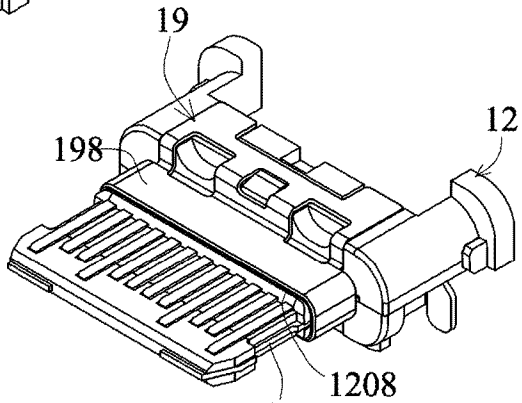
FIG. 17 is a pictorial view when the ground shielding member and the insulated seat according to the first embodiment of the invention are assembled to the predetermined position.
Figure 18:
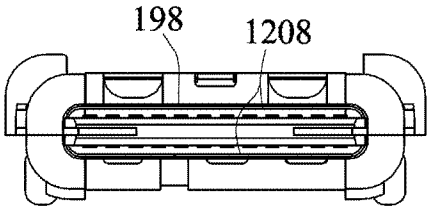
FIG. 18 is a front view when the ground shielding member and the insulated seat according to the first embodiment of the invention are assembled to the predetermined position.

Referring to FIGS. 13 to 18, as shown in FIG. 14, after the four-sided housing 198 of the ground shielding member 19 is fitted with and positioned at the inner sections 1208 of the two connection surfaces of the tongue 121, the width of the four-sided housing 198 is the same the maximum width of the metal partition plate 17. Thus, as shown in FIG. 13, the widths of the inner sections 1208 of the two connection surfaces of the tongue 121 need to be smaller than the maximum width of the metal partition plate 17. As shown in FIGS. 15 and 16, a four-sided cover shell 35 of the ground shielding member 19 before being assembled to the predetermined position has the width greater than the maximum width of the metal partition plate 17, and has the height smaller than the heights of the inner sections 1208 of the two connection surfaces. Thus, the four-sided housing 198 of the ground shielding member 19 can be fitted into the tongue 121. As shown in FIGS. 17 and 18, when the four-sided housing 198 is fitted with the inner section of the tongue 121, the resilient deformation decreases the width and increases the height so that it can be tightly fitted with and positioned at the inner sections 1208 of the two connection surfaces of the tongue 121.

The electrical connection socket of this embodiment is in the form of a horizontal type. That is, the insert port of the connection slot 16 faces frontwards, and the tongue 121 horizontally extends frontwards, so the outer end of the tongue 121 is a front end. However, a side-standing type (the insert port of the connection slot faces frontwards, and the tongue vertically extends frontwards) or a vertical type (the insert port of the connection slot 16 faces upwards, and the tongue vertically extends upwards) electrical connection socket implemented using the technical characteristics of the invention still falls within the modification of the invention.

According to the above-mentioned descriptions, the socket of this embodiment can be concluded to have the following advantages.

1. The insulated seat 12 is provided with the directly stacked first and second seats 125 and 126, which are respectively fixedly embedded into and injected molded with a terminal set so that the convenience in manufacturing can be achieved.

2. Although the first and second tongues 1251 and 1261 of this embodiment are only directly vertically stacked, without the limitation and engagement in the direction perpendicular to the two connection surfaces of the tongue, the outer tongue seat 129 has the overall thickness of the tongue so that the outer edge 1211 of the tongue is in the form of the integrally formed full height and is embedded into and fixed to the metal partition plate 17. Further working in conjunction with the metal housing 13 resting and positioning against the base seats of the first and second seats 125 and 126, the first and second tongues 1251 and 1261 and the outer tongue seat 129 still can achieve the good combining and positioning effects, and can be conveniently manufactured and assembled.

3. The ground shielding member 19 is integrally provided with two ground shielding sheets and fitted with and positioned at the insulated seat, so that the convenience in manufacturing and assembling can be achieved.

4. The tongue of the insulated seat is provided with the mutually stacked first and second tongues 1251 and 1261, and the first and second tongues are provided with the resilient overpressure leaning against the jointing surface, so that when the first and second tongues are stacked together, the first and second tongues resiliently press against each other through the resilient overpressure leaning against the jointing surface to achieve the flat contact without curving the metal housing.

5. The ground shielding member 19 is integrally provided with a four-sided cover shell 198 fitted with and positioned at the inner sections 1208 of the two connection surfaces of the tongue 121 to fit and position the vertically stacked first and second tongues 1251 and 1261, so that the combination of the first and second tongues 1251 and 1261 can be enhanced.

6. The two side sheets 193 of the four-sided cover shell 198 of the ground shielding member and the convex portion 174 of the two sides of the metal partition plate 17 resiliently contact together, so that the metal partition plate 17 and the metal housing 13 form the electrical connection, and the better electric effect can be obtained.

7. The two symmetrical spaces of the two connection surfaces of the tongue 121 inside the connection slot 16 have heights of the low-height design to achieve the slim and light effects.

8. The outer edge of the tongue is in the form of an integrally formed full height so that the stacked first and second tongues can be positioned more firmly and have the exterior having the better perceptive structural strength.

9. The four-sided cover shell 198 of the ground shielding member 19 from front to rear is fitted with and positioned at the inner sections 1208 of the two connection surfaces of the tongue 121 having the higher heights to fit and position the vertically stacked first and second tongues 1251 and 1261, so that the assembling becomes very convenient.

Figure 19:
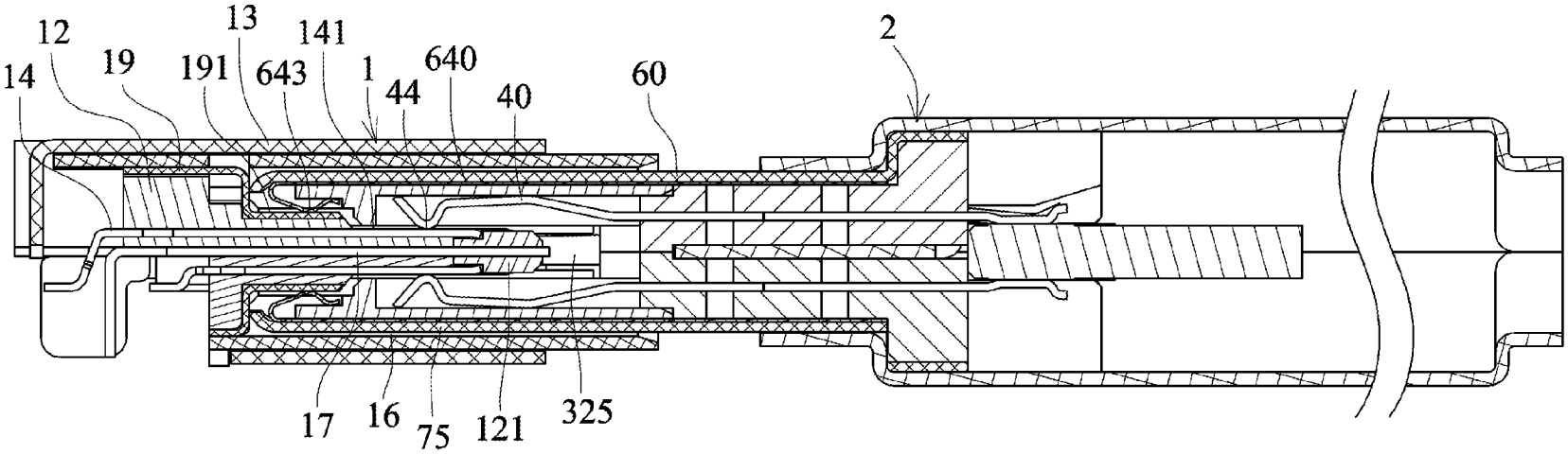
FIG. 19 is a side cross-sectional view showing docking between the first embodiment of the invention and an electric connector.

Referring again to FIG. 19, the dual-position duplex USB TYPE-C electrical connection socket 1 of this embodiment and a dual-position duplex USB TYPE-C electrical connection plug 2 can be electrically connected together in a reversible and duplex dual-position manner to achieve the doubled transmission and easy insertion effect. That is, when the front side or the reverse side of the plug 2 is inserted into the connection slot 16 of the socket 1, the contacts 44 of the terminals 40 of the two terminal sets of the plug 2 are electrically connected to the contacts 141 of the two terminal sets of the socket 1, the tongue 121 of the socket 1 is connected to a connection slot 325 of the plug 2, the inner sections of the two connection surfaces of the tongue 121 project much more beyond the outer sections of the two connection surfaces to work in conjunction with the front-high-rear-low structure of the connection slot 325 for fitting, and the contact 643 of the ground shielding member 640 of the plug is electrically connected to the first plate sheet 191 of the ground shielding member 19 of the socket.

In addition, the snapping convex portion (not shown) of the resilient snap of the plug snaps to the engaging slot 175 of the metal partition plate 17 of the socket, so that the plug and the socket form the inner snapping.

Figure 20:
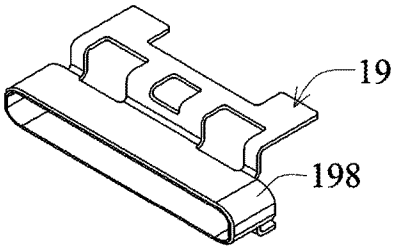
FIG. 20 is a pictorial view showing the ground shielding member according to the second embodiment of the invention.

Referring to FIG. 20, the second embodiment of the invention is substantially the same as the socket of the first embodiment except for the difference that the four-sided cover shell 198 of the ground shielding member 19 of this embodiment is formed of a metal material by way of drawing extension molding, so that no seam is present.

Figure 21:
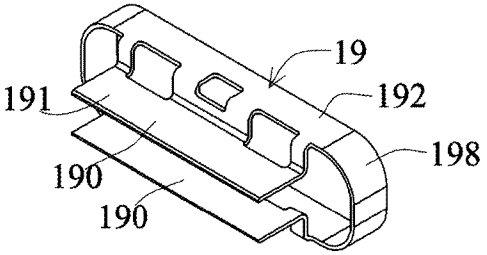
FIG. 21 is a pictorial view showing the ground shielding member according to the third embodiment of the invention.

Referring to FIG. 21, the third embodiment of the invention is substantially the same as the socket of the first embodiment except for the difference that the four-sided housing 198 of the ground shielding member 19 of this embodiment is formed with the second plate sheets 192 of the two ground shielding sheets 190, and the four-sided housing 198 is fitted with and positioned at the base seat of the insulated seat 12.

Figure 23:
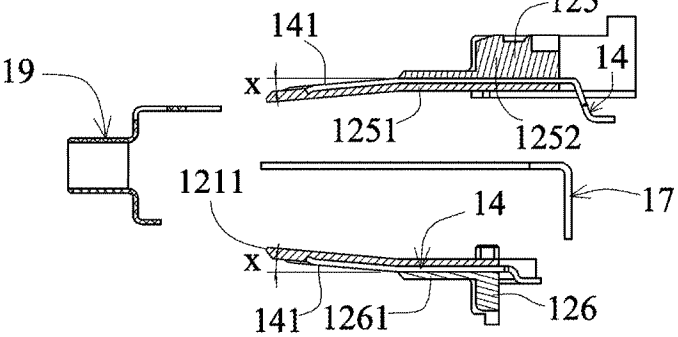
FIG. 23 is an exploded side view showing the insulated seat, the metal partition plate and the ground shielding member according to the fourth embodiment of the invention.
Figure 22:
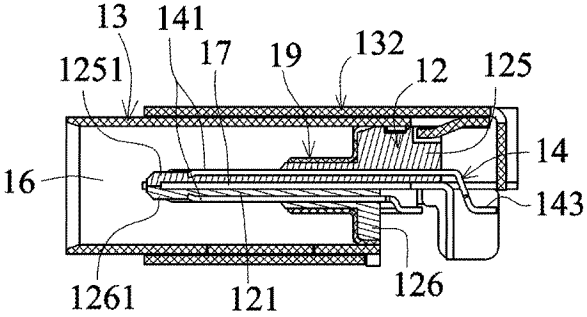
FIG. 22 is a side cross-sectional view according to the fourth embodiment of the invention.

Referring to FIGS. 22 and 23, the fourth embodiment of the invention is substantially the same as the socket of the first embodiment except for the difference that the tongue 121 of the insulated seat 12 of this embodiment is directly formed by the stacked first and second tongues 1251 and 1261 without the provision of an outer tongue seat to be embedded into and fixed to the metal partition plate 17.

Figure 25:
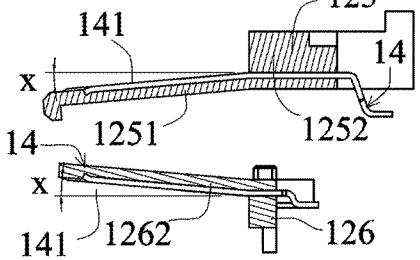
FIG. 25 is an exploded side view showing the insulated seat according to the fifth embodiment of the invention.
Figure 24:
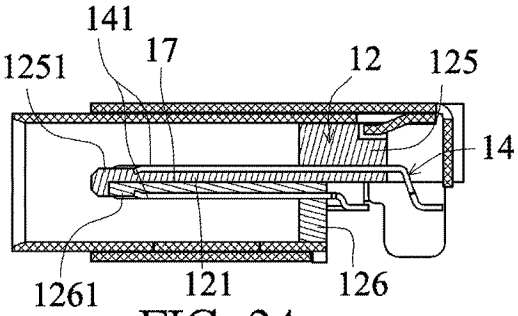
FIG. 24 is a side cross-sectional view according to the fifth embodiment of the invention.

Referring to FIGS. 24 and 25, the fifth embodiment of the invention is substantially the same as the fourth embodiment except for the difference that the outer end of the first tongue 1251 of the first seat of the insulated seat 12 of this embodiment forms the overall height of the outer end of the tongue 12, so that the outer edge 1211 of the tongue is in the form of the integrally formed full height. In addition, this embodiment is not provided with the ground shielding member and the metal partition plate.

Figure 28:
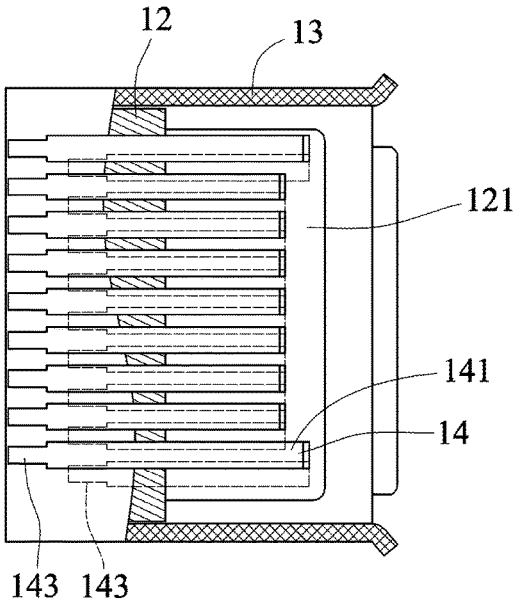
FIG. 28 is a cross-sectional top view showing the socket according to the sixth embodiment of the invention.
Figure 26:
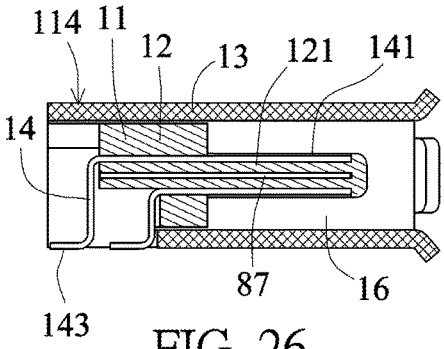
FIG. 26 is a side cross-sectional view showing the socket according to the sixth embodiment of the invention.
Figure 27:
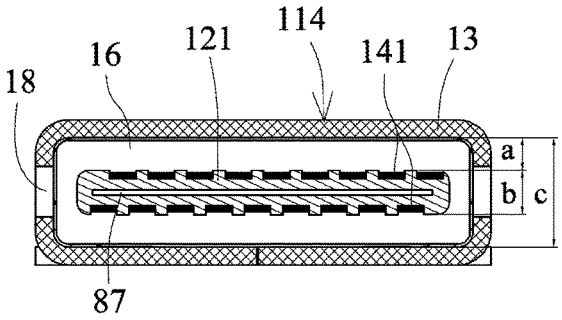
FIG. 27 is a front cross-sectional view showing the socket according to the sixth embodiment of the invention.

Referring to FIGS. 26 to 28, the sixth embodiment of the invention is a dual-position duplex electrical connection socket 114, which is similar to the first embodiment and provided with an insulated seat 12, two terminal sets, and a metal housing 13, wherein the difference resides in that the insulated seat 12 is integrally embedded into two rows of terminals 14 of the two terminal sets, the contacts 141 of the one row of first terminals 14 of the top and bottom surfaces of the tongue 121 are not vertically elastically movable, the two rows of first terminals 14 are arranged in a top-bottom staggered manner That is, the one row of first terminals 14 vertically correspond to two neighboring terminals of the other row of first terminals 14, the contacts of the two rows of first terminals 14 have the connection points with the circuit serial numbers arranged reversely. That is, the contacts 141 and the pins 143 of the two rows of first terminals 14 are arranged in a top-bottom staggered manner, and the pins 143 of two rows of first terminals 14 form one front row and one rear row. In addition, a horizontally extending metal sheet 87 is provided from the rear section of the base seat 122 of the insulated seat 12 to the tongue 121, so that the mutual electric interference between the two rows of first terminals 14 can be reduced, and the high-speed transmission is facilitated.

Referring to FIG. 27, the heights "a" of two symmetrical spaces of the two connection surfaces of the tongue 121 inside the connection slot 16 are about 0.6 mm, the height "b" of the tongue 121 is about 0.65 mm, the height "c" of the connection slot 16 is about 1.85 mm, the heights "a" of the two symmetrical spaces are larger than the small space (0.28 mm) of the connection slot of the biased electrical connection socket having the minimum height specification specified by USB Association and smaller than the large space (0.97 mm).

Figure 29:
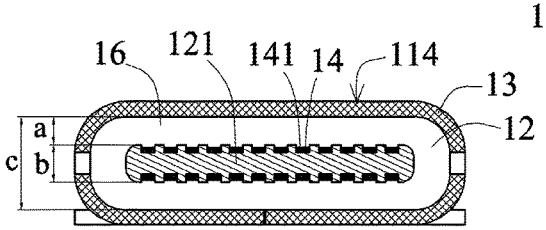
FIG. 29 is a front cross-sectional view according to the seventh embodiment of the invention.

Referring to FIG. 29, the seventh embodiment of the invention is a dual-position duplex electrical connection socket 114 for mutually docking, and is substantially the same as the sixth embodiment except for the difference that the shape of the connection slot 16 of this embodiment is in the form of two arced sides, and the contacts 141 of the two rows of first terminals 14 are vertically aligned.

The height "b" of the tongue 121 ranges from about 0.75 mm to 0.9 mm, the heights "a" of the two symmetrical spaces of the top and bottom surfaces of the tongue 121 range from about 0.7 mm to 0.95 mm, the height "c" of the connection slot 16 ranges from about 2.25 mm to 2.85 mm, and the heights "a" of the two symmetrical spaces are larger than the small space (0.28 mm) of the connection slot of the biased electrical connection socket having the minimum height specification specified by USB Association and are smaller than the large space (0.97 mm), so that the slim and light product can be easily manufactured.

The height "b" of the tongue 121 of this embodiment is about 0.83 mm, the heights "b" of the two symmetrical spaces of the top and bottom surfaces of the tongue 121 are about 0.83 mm, and the height "c" of the connection slot 16 is about 2.5 mm.

Figure 30:
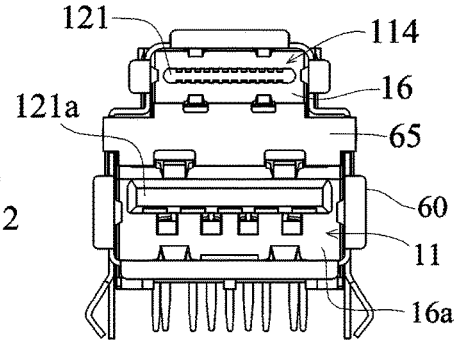
FIG. 30 is a front view according to the eighth embodiment of the invention.
Figure 32:
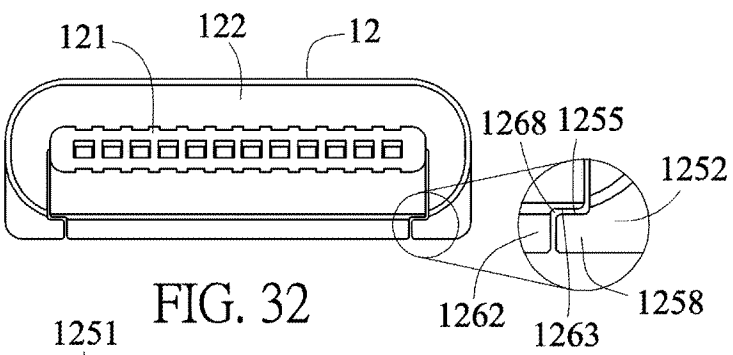
FIG. 32 is a front view showing the insulated seat according to the ninth embodiment of the invention.

Referring to FIG. 30, the eighth embodiment of the invention is a multi-layer connector having an upper layer being a dual-position duplex electrical connection socket 114 (first connector), and a lower layer being a biased USB 3.0 socket 11 (second connector). The insulated seats of the upper and lower layer connectors are covered by the same metal housing 60. The dual-position duplex electrical connection socket 114 is similar to the dual-position duplex electrical connection socket with the low-height design of the seventh embodiment. The heights of the two symmetrical spaces of the two connection surfaces of the tongue 121 inside the connection slot 16 similarly range from about 0.7 mm to 0.95 mm, and are larger than the small space (0.28 mm) of the connection slot of the biased electrical connection socket having the minimum height specification specified by USB Association and are smaller than the large space (0.97 mm). A connection slot 16*a* of the standard USB 3.0 socket 11 is provided with an upward biased tongue 121*a*. The connection slot 16 and the connection slot 16*a* are formed by the same metal housing 60 and are separated by a separating member 65.

This embodiment can achieve the multi-layer design of the dual-position low height socket, and the space can be utilized more effectively.

Referring to FIGS. 31 to 34A, the ninth embodiment of the invention is a dual-position duplex electrical connection socket provided with an insulated seat 12, two rows of first terminals 14 and a metal housing 13, and is substantially the same as the eighth embodiment and the ninth embodiment.

The insulated seat 12 is provided with a base seat 122 and a docking part. The docking part is a tongue 121. A front end of the base seat 122 is projectingly provided with the tongue 121. The inner end of the tongue 121 is connected to the base seat 122, and the outer end of the tongue 121 is a free end. The thickness of the base seat 122 is larger than that of the tongue 121. The plate surfaces of the two larger areas of the tongue 121 are two connection surfaces. The insulated seat 12 is provided with vertically stacked first seat 125 and second seat 126, so the tongue 121 horizontally extends frontwards. The inner end of the tongue is the rear end of the tongue. The outer end of the tongue is the front end of the tongue. The other two opposite edges of the tongue facing the inner and outer ends are the left and right sides. The first and second seats 125 and 126 are respectively embedded into and injection molded with the one row of first terminals 40. The first seat 125 is integrally formed with a first tongue 1251 and a first base seat 1252. The second seat 126 is integrally formed with a second tongue 1261 and a second base seat 1262. The connection surfaces of the first and second tongues 1251 and 1261 are stacked together to form the tongue 121. The connection surfaces of the first and second base seats 1252 and 1262 are stacked together to form the base seat 122. The front end of the first tongue 1251 projects downwards to form the overall height of the outer edge 1211 of the tongue 121. That is, the outer edge 1211 of the tongue is in the form of the integrally formed full height. The front end of the first tongue 1251 is provided with one row of engaging slots 1254. Each of the left and right sides of the first base seat 1252 is downwardly provided with a lateral arm 1253 connected to the left and right sides of the second base seat 1262.

The two rows of first terminals 14 are respectively embedded into and injection molded with the first and second seats 125 and 126, so that each of the jointing surfaces of the first and second tongues 1251 and 1261 of the first and second seats 125 and 126 forms two rows of cavities 1202. The first and second base seats 1252 and 1262 are formed with one row of through holes 1201. The first terminal 14 is integrally pressed and bent to form an extension 144, a fixing portion 142 and a pin 143. The portions of the top and bottom surfaces of the fixing portion 142 are embedded into and fixed to the first base seat 1252 (second base seat 1262). Each through hole 1201 is penetrated by the fixing portion 142 of the first terminal 14. The extension 144 is connected to the front end of the fixing portion 142 and extends to the first tongue 1251 (second tongue 1261). The inner surface of the extension 144 is embedded into and fixed to the first tongue 1251 (second tongue 1261) in a flat surface contact manner, and the outside of the extension 144 is exposed from the connection surface of the first tongue 1251 (second tongue 1261) to form the contact 141. So, the extension 144 is fixed and is not elastically movable. Each cavity 1202 corresponds to the extension 144 of the first terminal 14. The pin 143 is connected to the rear end of the fixing portion 142 and extends out of the first base seat 1252 (second base seat 1262), and has a horizontal end section. The contacts 141 of the two rows of first terminals 40 are respectively arranged on the two connection surfaces of the tongue 121 in an equally spaced manner, and are vertically aligned. The contacts 141 of the two rows of first terminals 40 are the same contact interface, and the circuit serial numbers of the connection points of the two contact interfaces are arranged reversely. In addition, the distal ends of the extensions 144 of the one row of first terminals 40 on the second seat 126 are bent upwards to form snapping convex portions 145 disposed on the front end of the second tongue 1261.

The metal housing 13 covers the insulated seat 30. The metal housing 13 rests against and engages with the base seat 122, and an inner front section thereof is formed with a connection slot 16 covering the tongue 121, wherein a fitting portion of an electrical connection plug may be reversibly inserted and positioned into the metal housing 13 at dual positions. The tongue 121 is horizontally disposed at the middle height of the connection slot 16 and extends frontwards. The inlet of the connection slot faces frontwards. The two connection surfaces of the tongue 121 form symmetrical spaces. The front-view shape of the connection slot 16 approaches a rectangle, is top-bottom symmetrical and left-right symmetrical and is in the form of two arced sides.

Figure 34:
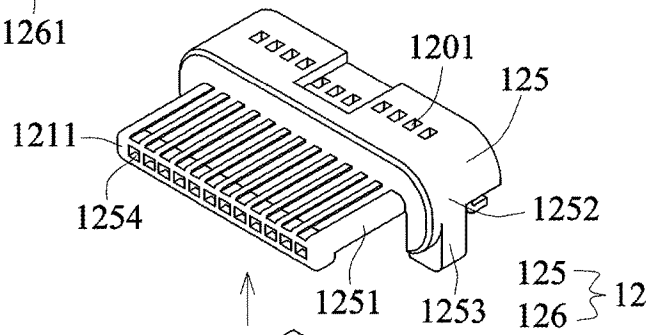
FIG. 34 is a pictorially exploded view showing the insulated seat according to the ninth embodiment of the invention.
Figure 34:
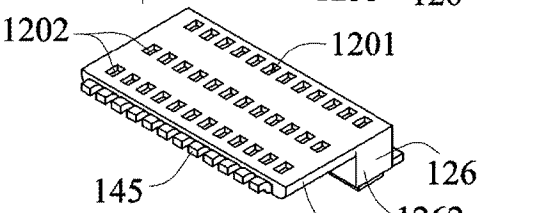
Figure 34A:
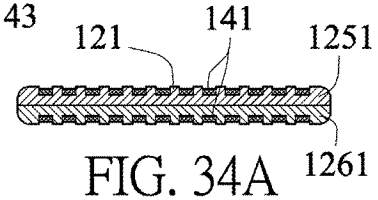
FIG. 34A is a cross-sectional view showing the tongue according to the ninth embodiment of the invention.
Figure 31:
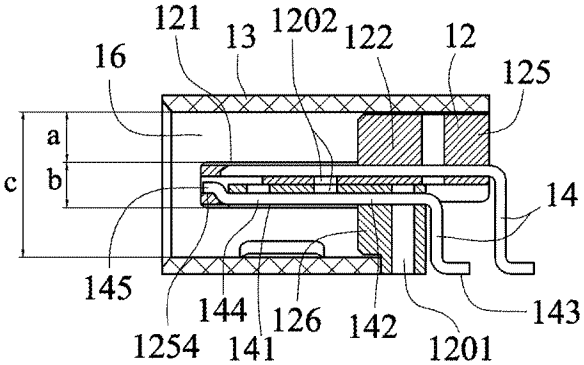
FIG. 31 is a side cross-sectional view according to the ninth embodiment of the invention.
Figure 33:
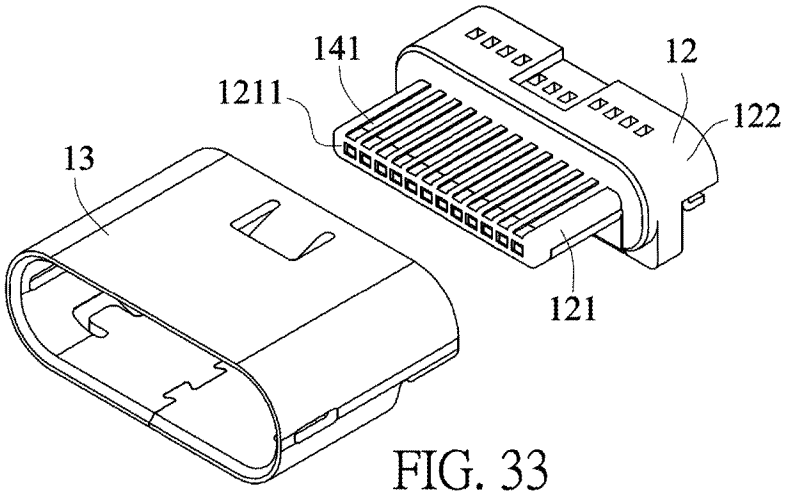
FIG. 33 is a pictorially exploded view according to the ninth embodiment of the invention.
Figure 35:
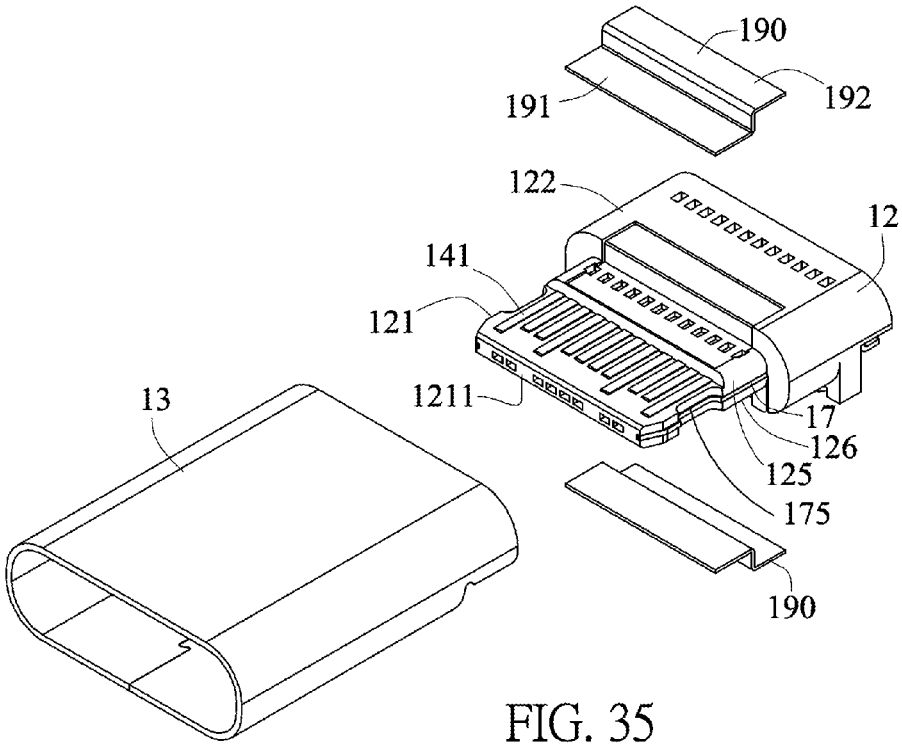
FIG. 35 is a pictorially exploded view showing the socket according to the tenth embodiment of the invention.

This embodiment is characterized in that the first and second tongues 1251 and 1261 mutually limit and combine with each other in the direction perpendicular to the two connection surfaces of the tongue through tongue snapping structures. The tongue snapping structures have snapping structures mutually limiting and engaging with each other in the top-to-bottom direction (the direction perpendicular to the two connection surfaces of the tongue). The tongue snapping structure is provided with the one row of engaging slots 1254 at the front end of the first tongue 1251, and is provided with the one row of snapping convex portions 145 at the front end of the second tongue 1261. The one row of snapping convex portions 145 may be snapped into the one row of engaging slots 1254 from rear to front. The downward snapping surfaces of the one row of snapping convex portions 145 and the upward snapping surfaces of the one row of engaging slots 1254 are horizontal, and have the clear top-to-bottom direction to mutually limit and engage with each other. Referring to FIG. 34, the first and second base seats 1252 and 1262 are provided with base seat snapping structures mutually engaged with each other. The base seat snapping structure has snapping structures mutually limiting and engaging with each other in the top-to-bottom direction. The base seat snapping structures are bottom ends of the inner surfaces of the two lateral arms 1253 of the first base seat 1252, which are inwardly projected to form snapping convex portions 1258, wherein the top surface of the snapping convex portion 1258 is an upward facing and horizontal snapping surface 1255. Each of the left and right sides of the second base seat 126 is provided with an engaging slot 1268. The bottom surface of the engaging slot 1268 is a downward facing and horizontal snapping surface 1263. When the snapping convex portion 1258 is snapped into the engaging slot 1268, the snapping surface 1255 is snapped to the bottom of the snapping surface 1263 to mutually limit and engage with each other in the top-to-bottom direction.

With the above-mentioned structure, the insulated seat 12 can be assembled by stacking the first seat 125 over the second seat 126 in a slightly frontward manner, and then pushing the second seat 126 further frontwards, so that the one row of snapping convex portions 145 of the front end of the second tongue 1261 are snapped into the one row of engaging slots 1254 of the first tongue 1251, and that the first and second tongues 1251 and 1261 mutually limit and engage with each other in the top-to-bottom direction. Meanwhile, the snapping convex portion 1258 of the first base seat 1252 is snapped into the engaging slot 1268 of the second base seat 1262, so that the snapping surface 1255 is snapped to the bottom of the snapping surface 1263 to make the first and second base seats 1252 and 1262 mutually limit and engage with each other in the top-to-bottom direction.

Because the insulated seat 12 of this embodiment is provided with the vertically stacked first seat 125 and second seat 126, the first and second seats 125 and 126 are respectively embedded into and injection molded with the one row of first terminals 40, so that the simplified manufacturing can be achieved, and the first and second seats 125 and 126 can indeed mutually limit and engage with each other in the top-to-bottom direction to ensure the smoothness of the end sections of the pins of the two rows of terminals.

Furthermore, the outer edge 1211 of the tongue has the integrally formed overall height, so that the stacked first and second tongues can be positioned more firmly to have the exterior with the better perception. The height "b" of the tongue 121 ranges from about 0.75 mm to 0.9 mm, the heights "a" of the two symmetrical spaces of the top and bottom surfaces of the tongue 121 range from about 0.7 mm to 0.95 mm, and the height "c" of the connection slot 16 ranges from about 2.25 mm to 2.85 mm, so that the slim and light product can be easily manufactured.

Referring to FIGS. 35 to 40, the tenth embodiment of the invention is a dual-position duplex USB TYPE-C electrical connection socket, and is substantially the same as the ninth embodiment except for the difference that this embodiment is further provided with two ground shielding sheets 190 and a metal partition plate 17.

The rear section 1208 of the connection surface of the first tongue 1251 is convex upwards and is thicker than the front section to form a grounding convex surface. The rear section 1208 of the connection surface of the second tongue is convex downwards and is thicker than the front section to form a grounding convex surface. The two ground shielding sheets 190 have the first and second plate sheets 191 and 192 in the ladder-like shape. The second plate sheet 192 is attached to the outside of the base seat 122, the first plate sheet 191 is attached to the grounding convex surface, and portions from the two grounding convex surfaces to the outside of the base seat 122 are provided with concave surfaces 1203 connected to the two ground shielding sheets 190. Both the first plate sheets 191 of the two ground shielding sheets 190 are in contact with the metal housing 13.

Each of the left and right sides of the middle section of the first tongue 1251 of the first seat 125 is provided with a slot 1236, and each of the left and right sides of the front end is provided with an engaging slot 1232. The front end of the first tongue 1251 projects downwards to form the overall height of the front edge 1211 of the tongue 121. The front section of the first tongue is provided with the one row of 8 engaging slots 1254, which are not arranged in an equally spaced manner and engage in the front-rear direction, and the bottom surface thereof has a convex surface 1259. The convex surface 1259 is flush with the bottom surface (connection surface) of the second tongue 1261, and is provided with four space providing slots 1233. The connection surface of the first base seat 1252 is provided with three engagement blocks 1234, the each of the two lateral arms 1253 thereof is provided with an engagement block 1237, and the engagement block 1237 is provided with a frontward engaging surface.

Each of the left and right sides of the front end of the metal partition plate 17 is frontwardly projectingly provided with an engaging plate 170, resting front edges 171 and concave portions 172 are provided between the two engaging plates 170. Each of the left and right sides of the front section of the metal partition plate 17 is provided with a depressed engaging slot 175. The length range of the engaging slot 175 has the sufficient structural strength, and approaches the complete plate surface. The rear section of the metal partition plate 17 is provided with three openings 173. The rear end of the metal partition plate 17 is provided with two notches 176 and downwardly extends to have two pins 177.

Each of the left and right sides of the middle section of the second tongue 1261 of the second seat 126 is provided with a slot 1274. The rear end of the connection surface of the second base seat 1262 is provided with two engagement blocks 1273, and each of the left and right sides thereof is provided with an engagement block 1272. The engagement block 1237 is provided with a backward engaging surface.

The lengths of the contacts 141 of the one row of first terminals 14 on the first and second seats 125 and 126 are different (the 4 longer ones are ground and power supply terminals, and the 8 shorter ones are 4 pairs of signal terminals). The lengths of the contacts 141 of the two rows of first terminals are correspondingly arranged reversely. The distal ends of the first terminals 14 of the 8 shorter contacts of the second tongue 1261 are convex upwards and provided with the snapping convex portions 145 projecting beyond and above the front end of the second tongue. Distal ends 146 of the first terminals 14 of the four longer contacts horizontally project beyond the front end of the second tongue.

Figure 36:
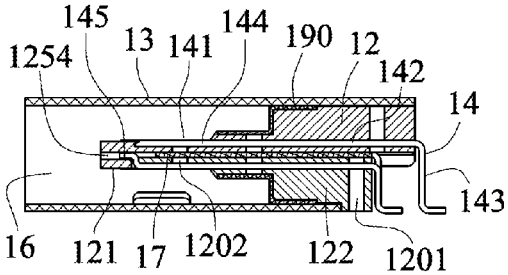
FIG. 36 is a side cross-sectional view showing the socket according to the tenth embodiment of the invention.
Figure 37:
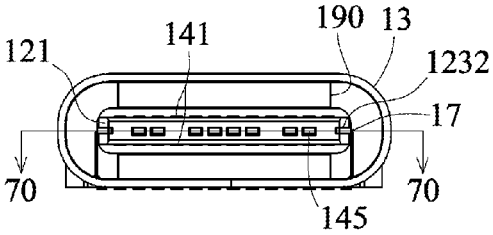
FIG. 37 is a front view showing the socket according to the tenth embodiment of the invention.
Figure 38:
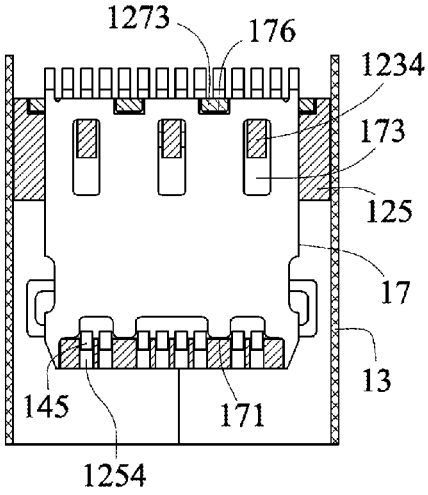
FIG. 38 is a cross-sectional top view showing the socket according to the tenth embodiment of the invention.
Figure 40:
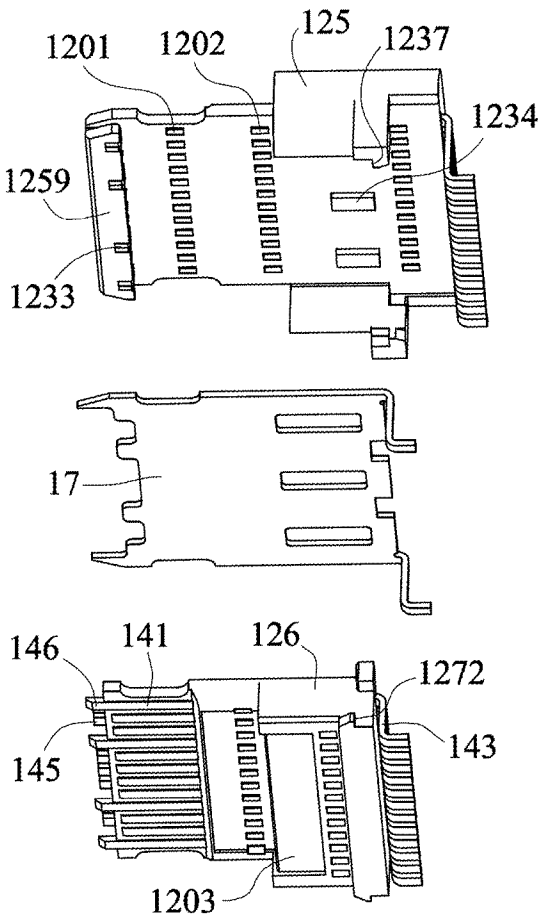
FIG. 40 is a pictorially exploded view showing the first seat, the metal partition plate and the second seat of the socket according to the tenth embodiment of the invention.
Figure 39:
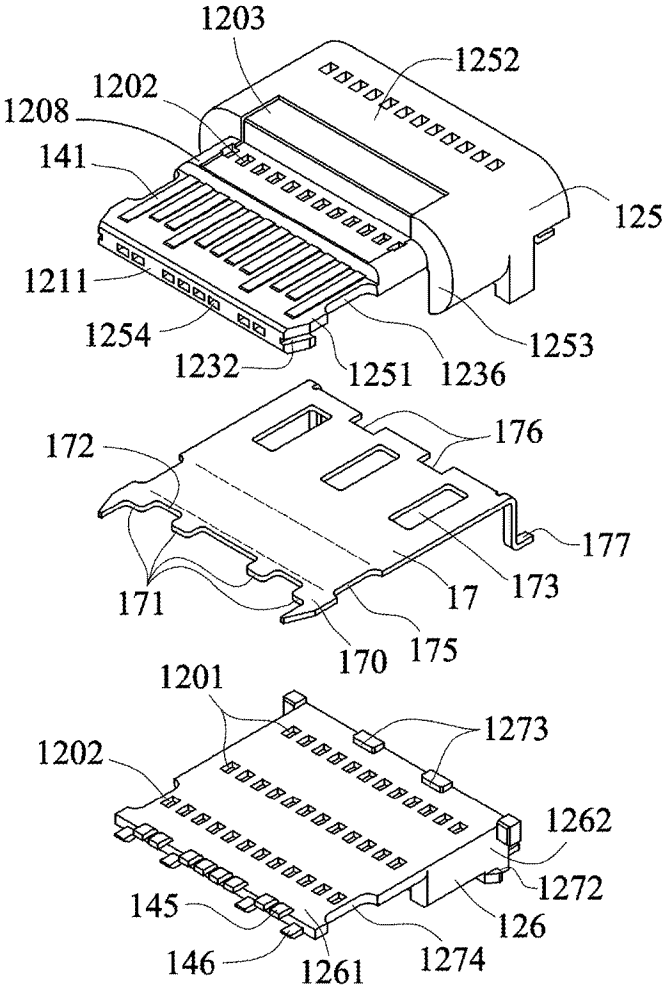
FIG. 39 is a pictorially exploded view showing the first seat, the metal partition plate and the second seat of the socket according to the tenth embodiment of the invention.
Figure 41:
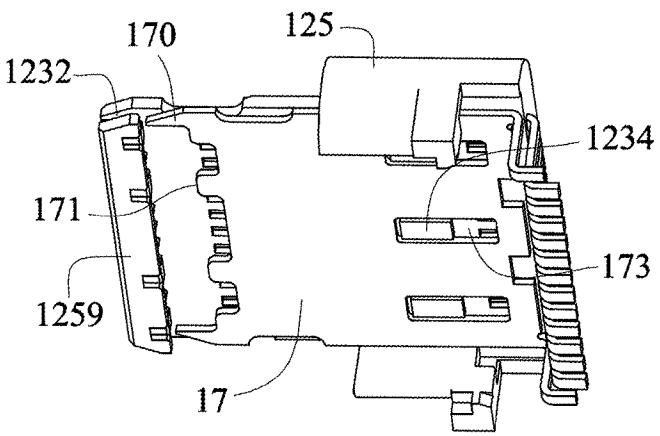
FIG. 41 is a pictorial view showing the assembled state of the socket according to the tenth embodiment of the invention.
Figure 42:
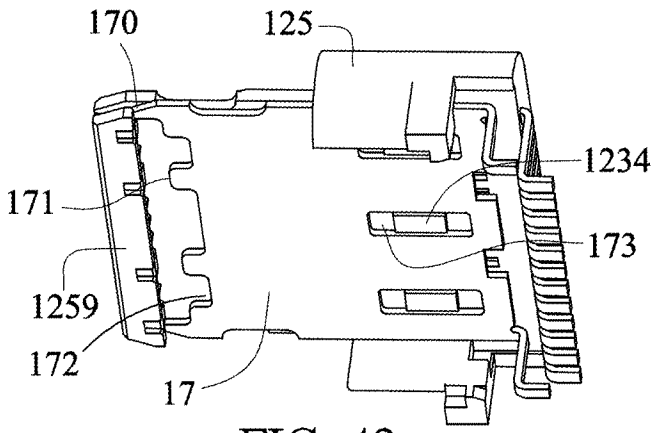
FIG. 42 is a pictorial view showing the assembled state of the socket according to the tenth embodiment of the invention.
Figure 43:
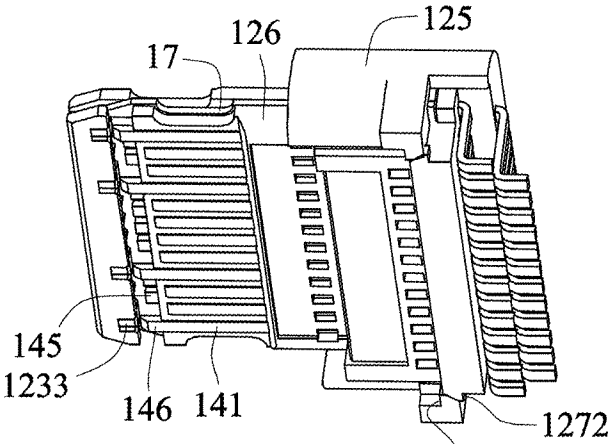
FIG. 43 is a pictorial view showing the assembled state of the socket according to the tenth embodiment of the invention.
Figure 44:
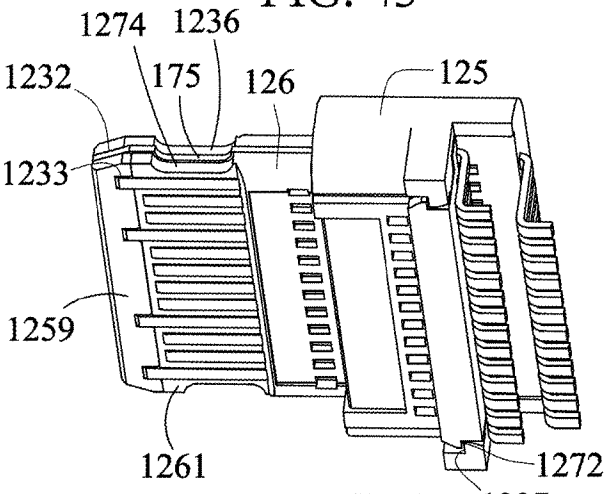
FIG. 44 is a pictorial view showing the assembled state of the socket according to the tenth embodiment of the invention.

Referring to FIGS. 41 to 44 showing the assembling of the first and second seats 125 and 126 and the metal partition plate 17. First, as shown in FIG. 41, the metal partition plate 17 is assembled with the connection surface of the first seat 125, and the three engagement blocks 1234 engage with the three openings 173 of the metal partition plate 17. Next, as shown in FIG. 42, the metal partition plate 17 is pushed frontward by a partial stroke. At this time, the engaging plate 170 of the metal partition plate 17 is snapped into the engaging slot 1232. Then, as shown in FIG. 43, the second seat is assembled with the connection surface of the first seat 125. At this time, the engagement block 1273 of the second seat engages with the notch 176 of the metal partition plate 17 (see FIGS. 38 and 39), and the snapping convex portions 145 of the distal ends of the first terminals 14 of the eight shorter contacts correspond to the concave portions 172 of the metal partition plate 17. Next, as shown in FIG. 44, the second seat 126 is pushed frontwards. At this time, the front end of the second tongue 1261 is aligned with and connected to the convex surface 1259 of the first tongue, the snapping convex portions 145 of the distal ends of the eight first terminals 14 are snapped into the one row of eight engaging slots 1254 of the first tongue (as shown in FIG. 36) to form the tongue snapping structure, and the distal ends 146 of the first terminals 14 of the four longer contacts are connected to the four space providing slots 1233 of the convex surface 1259. The resting front edge 171 of the metal partition plate 17 stops at the convex surface 1259, and the rear edges of the three openings 173 stop at the rear ends of the three engagement blocks 1234 (as shown in FIG. 38). Thus, the metal partition plate 17 has the very firm position limiting in the frontward direction, and the engagement block 1273 of the second seat engages with the notch 176 of the metal partition plate 17 in the backward direction. In addition, the slots 1236 and 1274 of the first and second tongues 1261 vertically correspond to the engaging slots 175 of the metal partition plate 17, and the engagement block 1237 of the first base seat is snapped to the engagement block 1272 of the second base seat, so that the second seat 126 cannot move backwards again.

Figure 45:
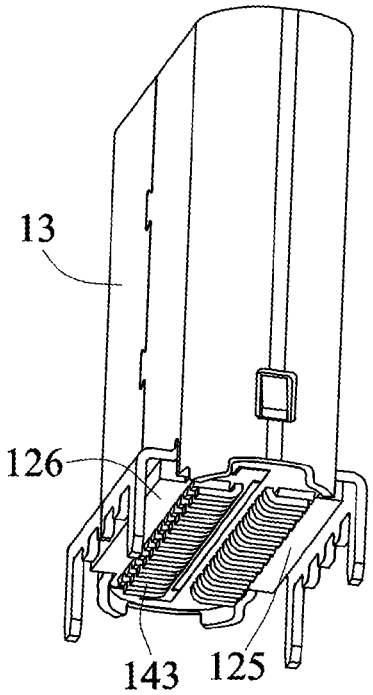
FIG. 45 is a pictorial view according to the eleventh embodiment of the invention.
Figure 46:
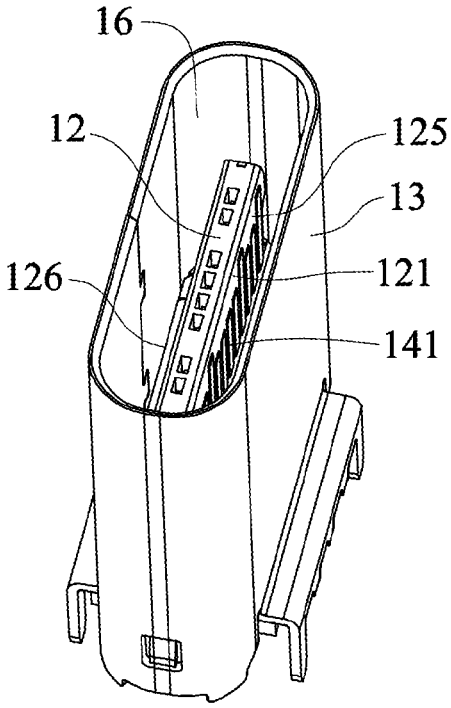
FIG. 46 is a pictorial view according to the eleventh embodiment of the invention.

Referring to FIGS. 45 and 46, the eleventh embodiment of the invention is substantially the same as the tenth embodiment except for the difference that the first and second seats 125 and 126 of this embodiment are disposed vertically, the tongue 121 extends vertically upwards, and the inlet of the connection slot 16 faces upwards.

Figure 47:
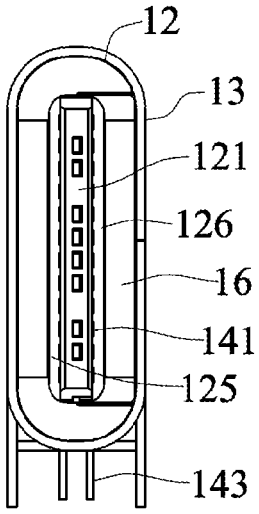
FIG. 47 is a front view of the twelfth embodiment of the invention.

Referring to FIG. 47, the twelfth embodiment of the invention is substantially the same as the tenth embodiment except for the difference that the first and second seats 125 and 126 of this embodiment are disposed in a side-standing manner, the tongue 121 stands vertically and extends frontwards, and the inlet of the connection slot 16 faces frontwards.

Figure 48:
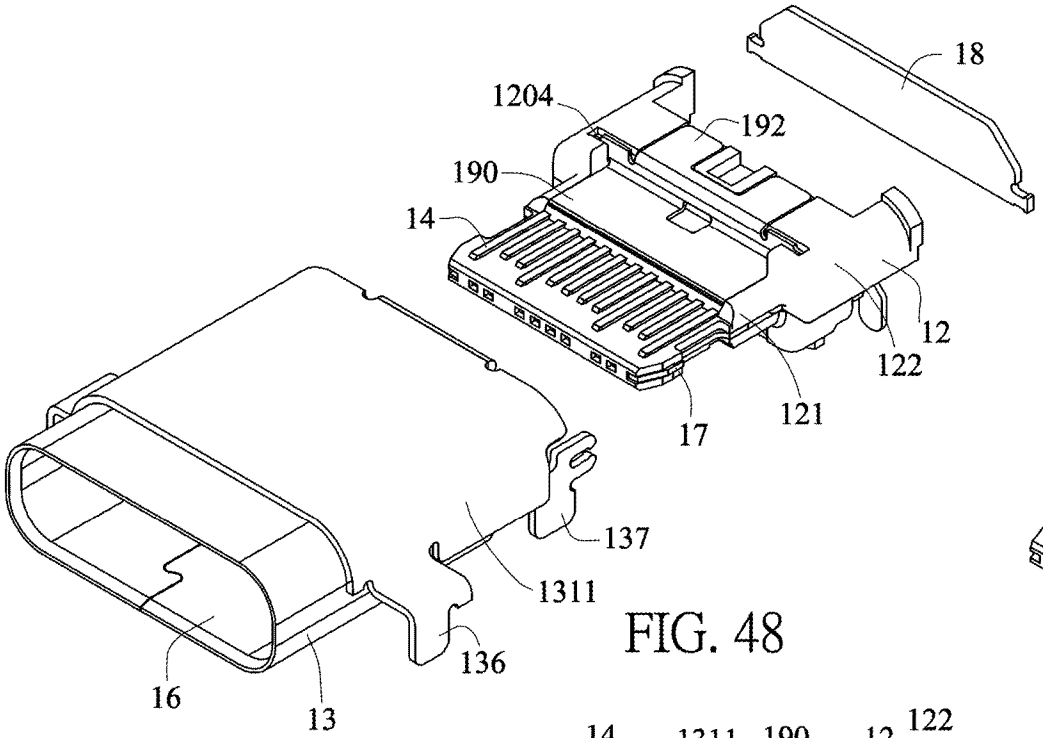
FIG. 48 is a pictorially exploded view according to the thirteenth embodiment of the invention.
Figure 50:
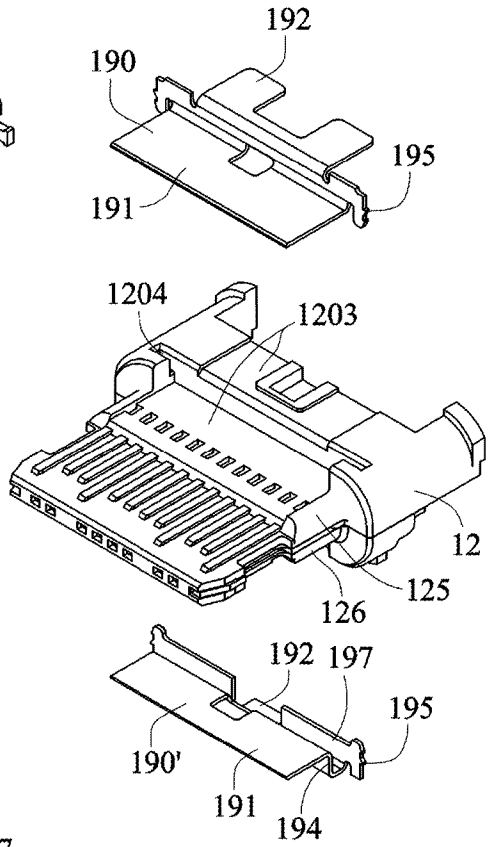
FIG. 50 is a side cross-sectional view according to the thirteenth embodiment of the invention.
Figure 49:
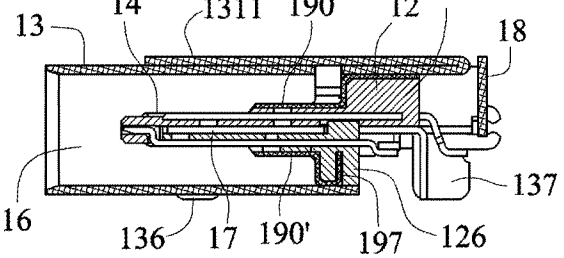
FIG. 49 is a partially pictorially exploded view according to the thirteenth embodiment of the invention.

Referring to FIGS. 48 to 50, the thirteenth embodiment of the invention is a dual-position duplex USB TYPE-C electrical connection socket, and is substantially the same as the socket of the tenth embodiment except for the difference that the top surface of the rear end of the metal housing 13 of this embodiment is integrally connected to a reversely bent plate 1311, which is stacked above the metal housing above the connection slot 16. Because the rear end of the metal housing 13 is connected to the reversely bent plate 1311, a metal rear plate 18 needs to be assembled. The reversely bent plate 1311 is integrally provided with two first plate connecting members 136 disposed on the left and right sides of the connection slot 16. Each of the left and right sides of the rear end of the metal housing 13 is provided with a second plate connecting member 137, so that the four circumferential surfaces of the connection slot 16 may be complete metal plate surfaces to achieve the smaller electromagnetic compatibility covering electromagnetic interference (EMI) and the good electromagnetic susceptibility (EMS).

In addition, the positioning of the ground shielding sheet 190 above the insulated seat 12 is substantially the same as the tenth embodiment, but the first plate 192 extends backwards by a longer length and may be attached to the top surface of the base seat of the insulated seat 12 firmer. The engaging portion 195 of the left and right sides of the vertical plate 194 further laterally moves outwards and extends downwards by a length, so that the engaging portion 195 can be inserted into the base seat firmer and can provide spaces for the one row of first terminals 14.

A vertical sheet 194 is disposed between the first and second plate sheets 192 and 193 of the ground shielding sheet 190 below the insulated seat 12. The first plate sheet 192 is further connected to another vertical sheet 197. The two vertical sheets 194 and 197 are correspondingly connected to the first plate sheet 192 to form a U-shaped body engaged with the bottom end of the base seat 122. The engaging portion 195 is connected to the left and right sides of the vertical sheet 197.

This embodiment has the plate-depressed configuration. The second base seat of the second seat 126 is shorter, so the ground shielding sheet 190 below the insulated seat 12 needs to be designed to have the U-shaped body engaged with the second base seat.

Figures 51, 52:
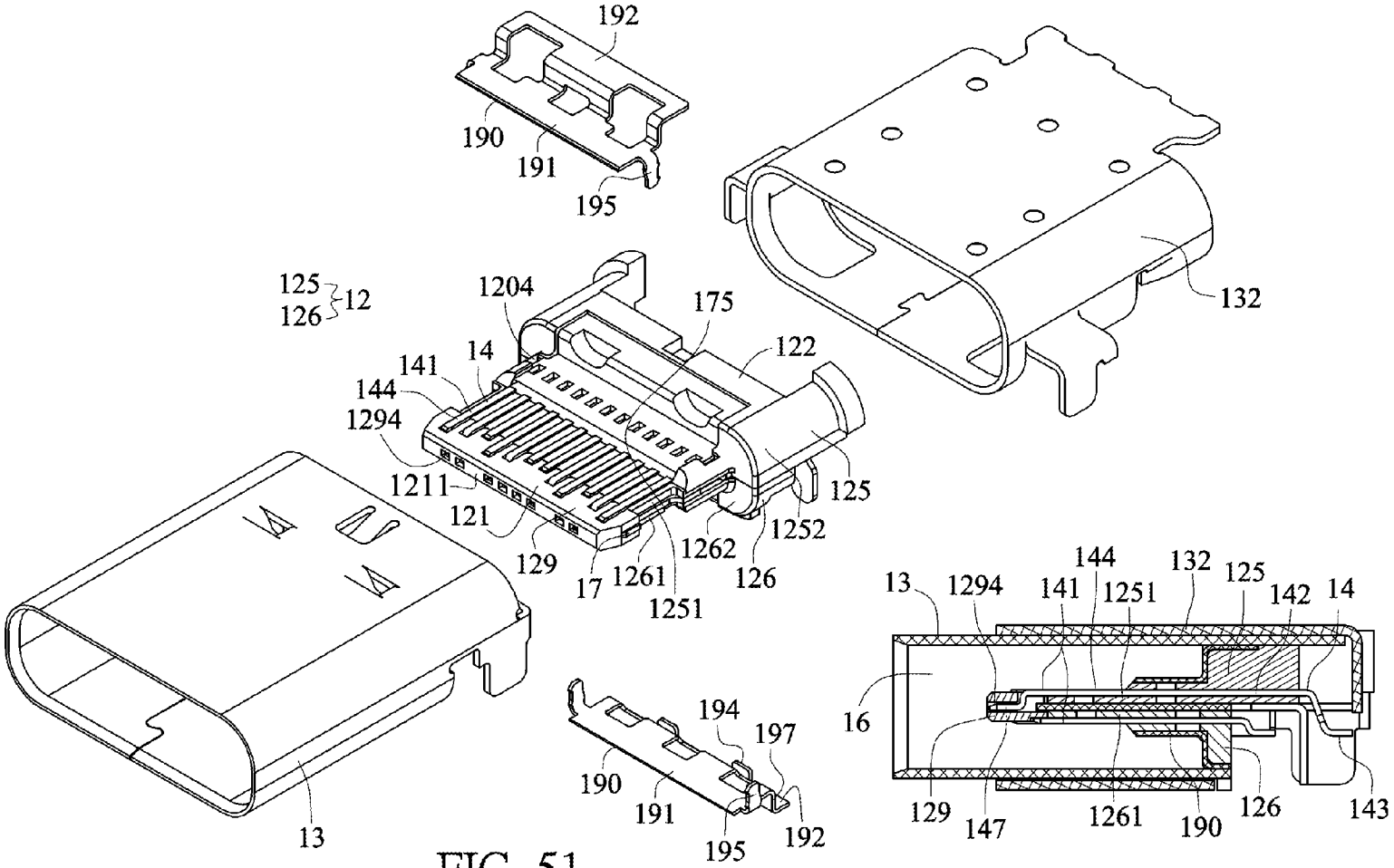
FIG. 51 is a pictorially exploded view according to the 14th embodiment of the invention.
FIG. 52 is a side cross-sectional view according to the 14th embodiment of the invention.
Figure 53:
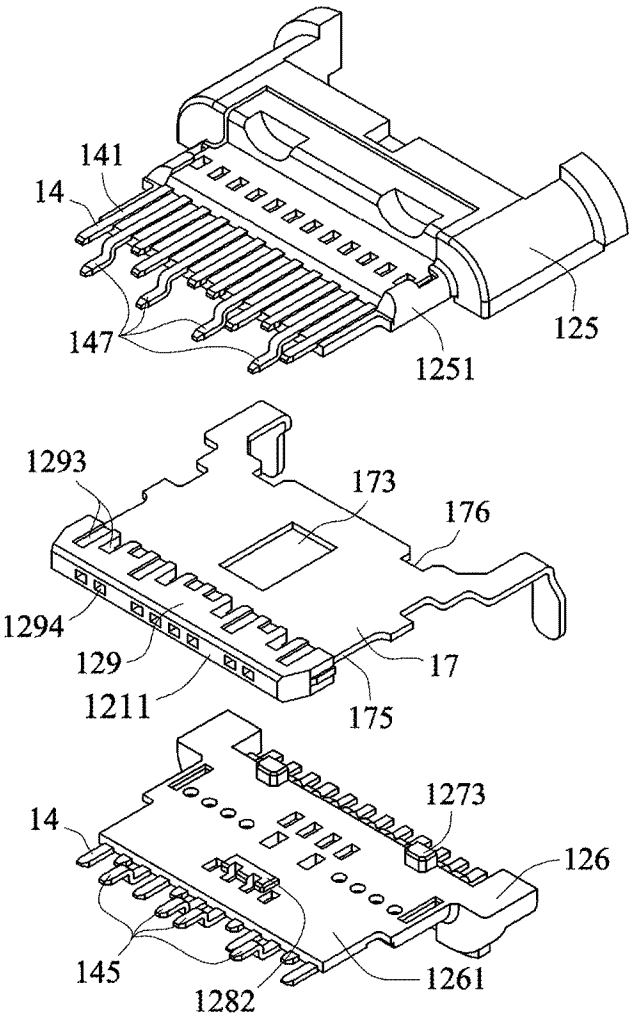
FIG. 53 is a partially pictorially exploded view according to the 14th embodiment of the invention.

Referring to FIGS. 51 to 53, the 14th embodiment of the invention is a dual-position duplex USB TYPE-C electrical connection socket, and is substantially the same as the tenth embodiment and the thirteenth embodiment except for the difference that the tongue of this embodiment comprises an outer tongue seat 129. The outer tongue seat 129 is combined and engaged with the outer ends (front ends) of the first and second tongues 1251 and 1261. The outer ends of the first and second tongues 1251 and 1261 are connected to the outer tongue seat 129 to form the tongue 121. The outer edge 1211 of the tongue 121 has the integrally formed overall height.

The outer tongue seat 129 is provided with one row of 8 slots 1294, which have the same height and are separately arranged in the front-rear direction. The slot 1294 can be inserted from rear to front. Two connection surfaces of the outer tongue seat 129 are provided with depressed portions 1293 for providing spaces for one row of first terminals 14 of the first and second tongues 1251 and 1261.

The outer end of the metal partition plate 17 and the outer tongue seat 129 are embedded and fixed together.

The end sections of the four first terminals 14 of the one row of first terminals 14 of the second seat 126 are bent upwards and disposed at the middle thickness of the tongue and in the form of the horizontal snapping convex portion 145. The end sections of the four first terminals 14 of the one row of first terminals 14 of the first seat 125 are bent downwards and disposed at the middle thickness of the tongue and in the form of the horizontal snapping convex portion 147. The four snapping convex portions 145 and the four snapping convex portions 147 are staggered and arranged in one row and flush with each other.

By fitting and engaging one row of eight snapping convex portions 145 and 147 into and with one row of eight slots 1294 of the outer tongue seat 129, the first and second tongues 1251 and 1261 can mutually limit the positions by the outer tongue seat 129 in the direction perpendicular to the two connection surfaces of the tongue. The second tongue 1261 is provided with an engagement block 1282 snapping to the opening 173 of the metal partition plate 17. The first tongue 1251 is also provided with the engagement block snapping to the opening 173 of the metal partition plate 17. After the first and second tongues 1251 and 1261 are snapped to and assembled with the outer tongue seat 129, the left and right sides form slots corresponding to the slots 175 of the left and right sides of the metal partition plate.

In addition, each of the two ground shielding sheets 190 on the left and right sides of the first plate sheet 191 is provided with an engaging portion 195 perpendicularly engaged with slots 1204 of two left and right sides of the rear section of the tongue.

Figure 54:
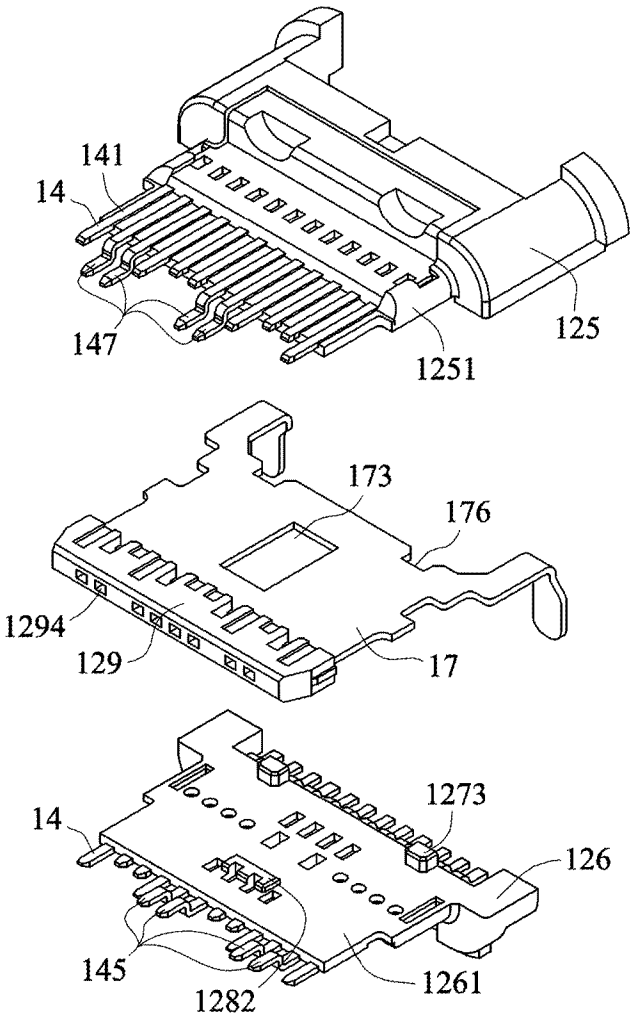
FIG. 54 is a partially pictorially exploded view showing another implementation according to the 14th embodiment of the invention.

Referring to FIG. 54 showing another variation of this embodiment, the first terminals 14 of the four snapping convex portions 145 are two pairs of signal terminals, and the first terminals 14 of the four snapping convex portions 147 are also two pairs of signal terminals.

Figure 56:
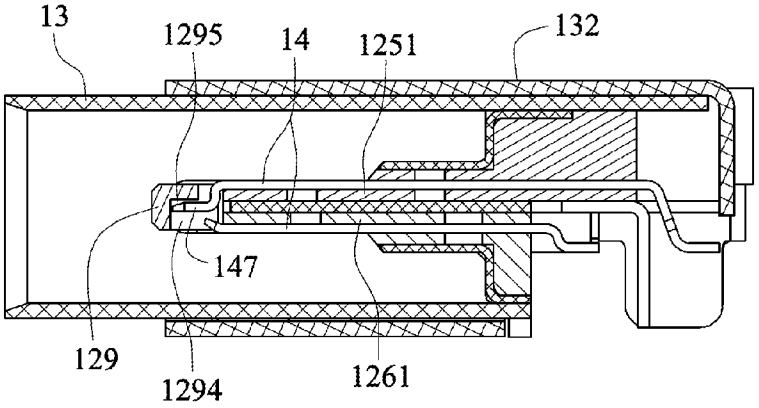
FIG. 56 is a side cross-sectional view according to the 15th embodiment of the invention.
Figure 57:
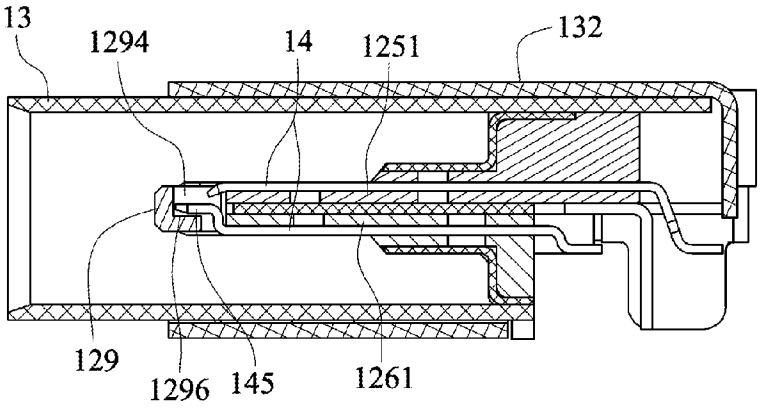
FIG. 57 is another side cross-sectional view according to the 15th embodiment of the invention.
Figure 55:
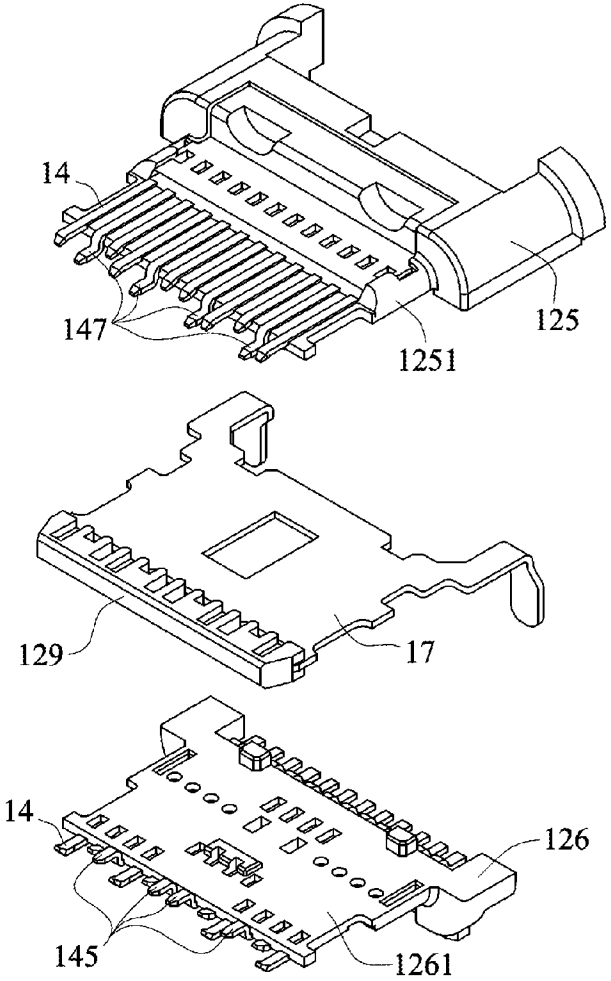
FIG. 55 is a partially pictorially exploded view according to the 15th embodiment of the invention.

Referring to FIGS. 55 to 57, the 15th embodiment of the invention is substantially the same as the 14th embodiment except for the difference that one row of slots 1294 of the outer tongue seat 129 of this embodiment are engaged with the snapping convex portions 147 of the first tongue 1251 only through the upper engaging surface 1295 and the lower portion is left open, and are engaged with the snapping convex portions 145 of the second tongue 1261 only through the lower engaging surface 1296 and the upper portion is left open, so that the outer tongue seat 129 can be formed by way of plastic injection molding using upper and lower molds combined vertically without the use of the slider, and the manufacturing processes are more convenient.

Figure 59:
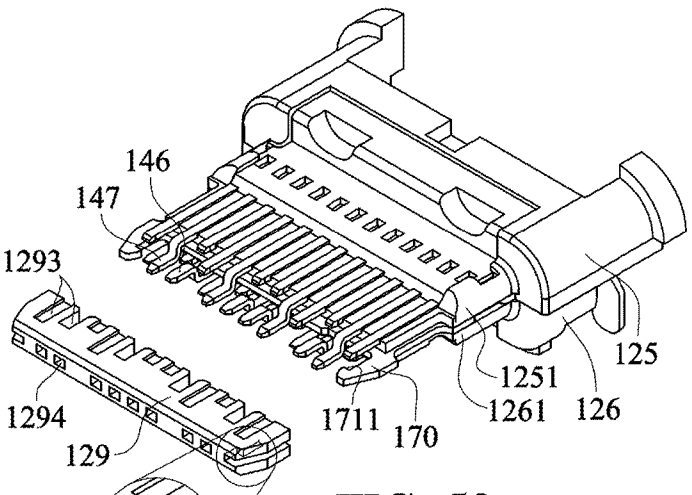
FIG. 59 is another partially pictorially exploded view according to the 16th embodiment of the invention.
Figure 60:
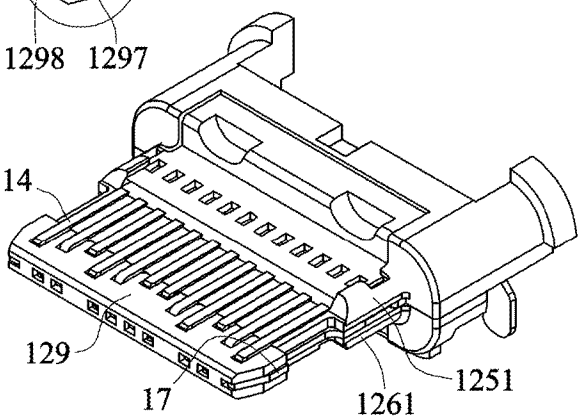
FIG. 60 is a partially pictorially assembled view according to the 16th embodiment of the invention.
Figure 58:
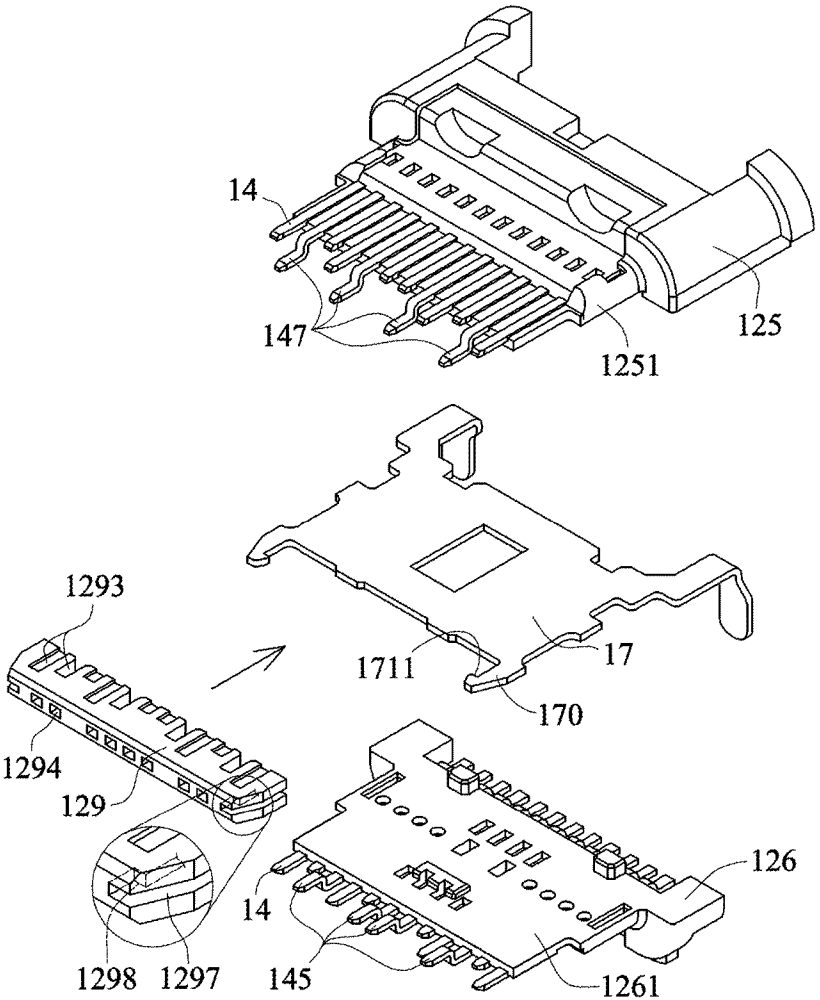
FIG. 58 is a partially pictorially exploded view according to the 16th embodiment of the invention.

Referring to FIGS. 58 to 60, the 16th embodiment of the invention is substantially the same as the 14th embodiment except for the difference that the outer tongue seat 129 of this embodiment is not embedded into and fixed to the metal partition plate 17, each of the left and right sides of the outer tongue seat 129 is provided with a slot 1297, the slot 1297 is provided with a backward stopping stop surface 1298, each of the left and right sides of the front end of the metal partition plate 17 is frontwardly projectingly provided with an engaging plate 170 snapped to the slot 1297 and provided with an engaging surface 1711 engaged with the stop surface 1298.

Figure 63:
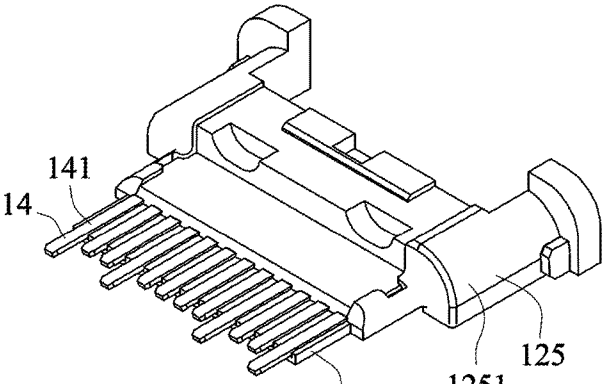
FIG. 63 is a partially pictorially exploded view according to the 17th embodiment of the invention.
Figure 63:
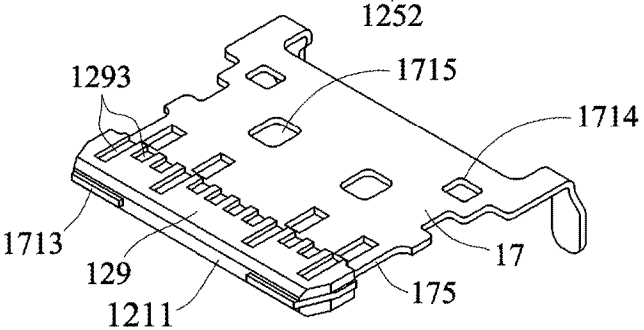
Figure 63:
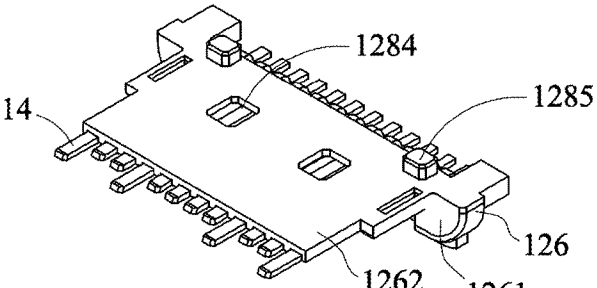
Figure 61:
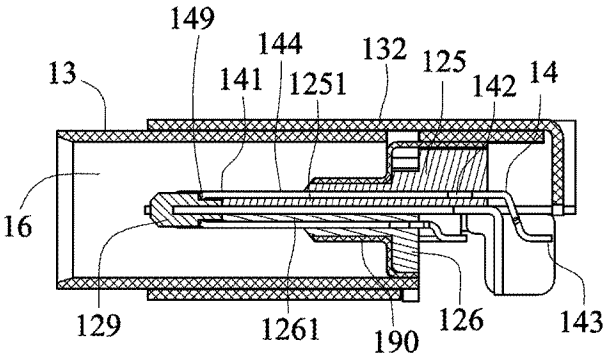
FIG. 61 is a side cross-sectional view according to the 17th embodiment of the invention.
Figure 62:
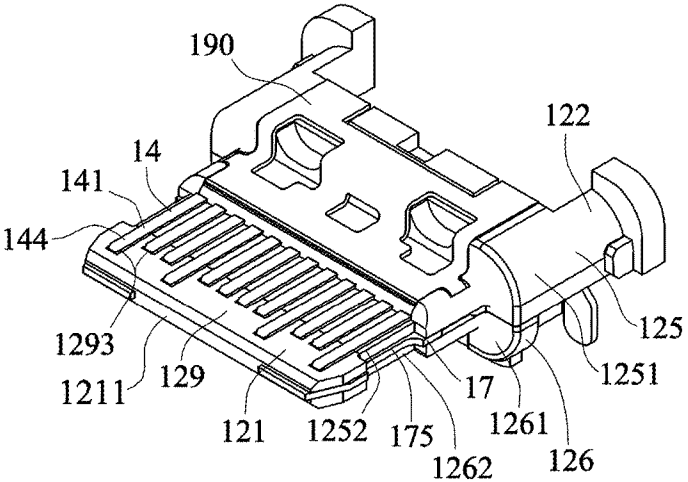
FIG. 62 is a partially pictorially assembled view according to the 17th embodiment of the invention.

Referring to FIG. 61 to FIG. 63, the 17th embodiment of the invention is a dual-position duplex USB TYPE-C electrical connection socket, and is substantially the same as the 14th embodiment except for the difference that the tongue 121 of this embodiment is similarly composed of an outer tongue seat 129 and the first and second tongues 1251 and 1261. That is, the outer ends of the first and second tongues 1251 and 1261 are connected to the outer tongue seat 129 to form the tongue 121. The outer tongue edge of the tongue 121 similarly has the integrally formed overall height. The outer end of the metal partition plate 17 and the outer tongue seat 129 are embedded and fixed together.

The difference resides in that the outer tongue seat 129 is not provided with one row of slots in the front-rear direction, and only the two connection surfaces are provided with depressed portions 1293 for providing the spaces for the one row of first terminals 14 of the first and second tongues 1251 and 1261. The depressed portions 1293 are one row of four longer and eight shorter depressed cavities. The extensions 144 of the one row of first terminals 14 of the first and second base seats 126 are not elastically movable and horizontally linearly extend, and have the end sections, which are not bent and do not rest against and snap to the depressed portions 1293. However, a distal end 149 of the extension is slightly bent toward the one row of depressed portions 1293 of the two connection surfaces of the outer tongue seat and is lower than the connection surface to prevent from tilting upwards.

The first and second seats 125 and 126 are limited and engaged with the metal partition plate 17 except for in the direction perpendicular to the two connection surfaces of the tongue. That is, the connection surface of the second seat 126 is provided with a projecting engagement block 1285 passing through and engaging with an engagement hole 1714 of the metal partition plate 17 and snapping to the concave portion (not shown) of the connection surface of the first seat 125. The connection surface of the first seat 125 is provided with a projecting engagement block (not shown) passing through and engaging with an engagement hole 1715 of the metal partition plate 17 and snapping to a concave portion 1284 of the connection surface of the second seat 125.

In addition, the outer end 1713 of the metal partition plate 17 projects beyond the front edge of the outer tongue seat 129.

Although the first and second tongues 1251 and 1261 of this embodiment are only directly vertically stacked without mutually limiting and engaging with each other in the direction perpendicular to the two connection surfaces of the tongue, the outer tongue seat 129 has the overall thickness of the tongue and is embedded and fixed into the metal partition plate 17. Further working in conjunction with the metal housing 13 resting and positioning against the base seats of the first and second seats 125 and 126, the first and second tongues 1251 and 1261 and the outer tongue seat 129 still can achieve the good combining and positioning effects. This embodiment provides the more convenient manufacturing and assembling processes.

Figure 65:
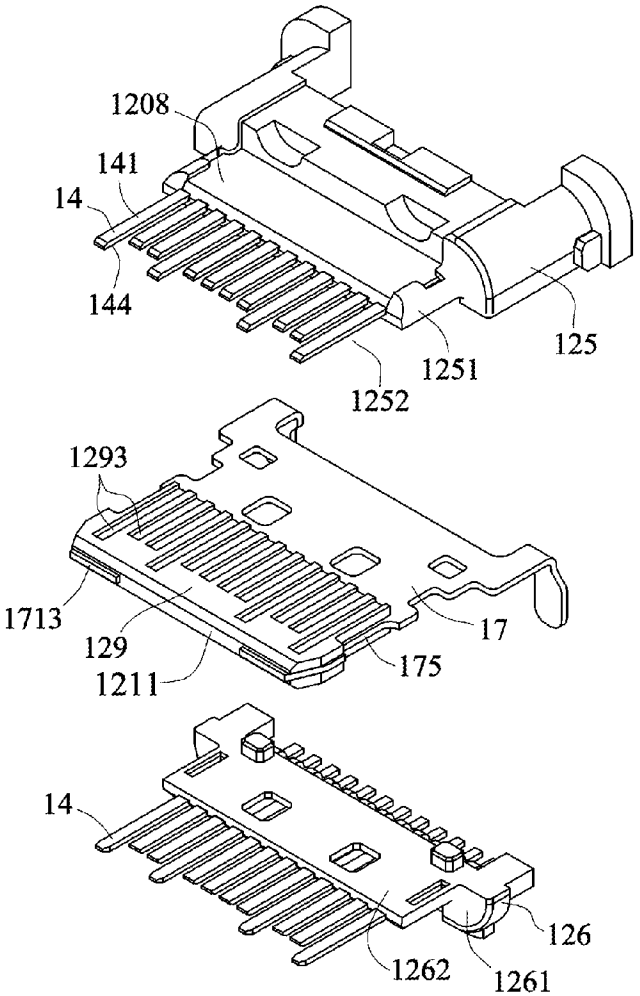
FIG. 65 is a partially pictorially exploded view according to the 18th embodiment of the invention.
Figure 64:
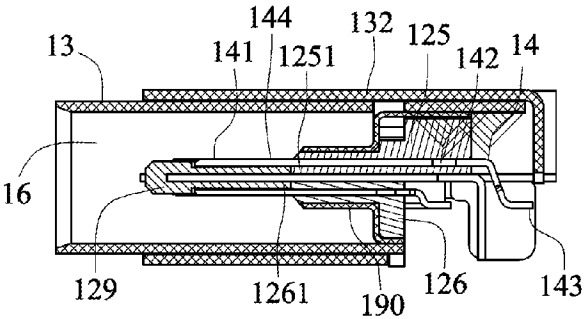
FIG. 64 is a side cross-sectional view according to the 18th embodiment of the invention.

Referring to FIGS. 64 and 65, the 18th embodiment of the invention is substantially the same as the 17th embodiment except for the difference that the outer tongue seat 129 of this embodiment is longer, and the first and second tongues 1251 and 1261 are relatively shortened to function only as the rear section 1208 of the connection surface of the grounding convex surface. Thus, the extensions 144 of the one row of first terminals 14 of the first and second seats 126 have the longer lengths to be in flat surface contact with and to snap to the depressed portions 1293.

Figure 66:
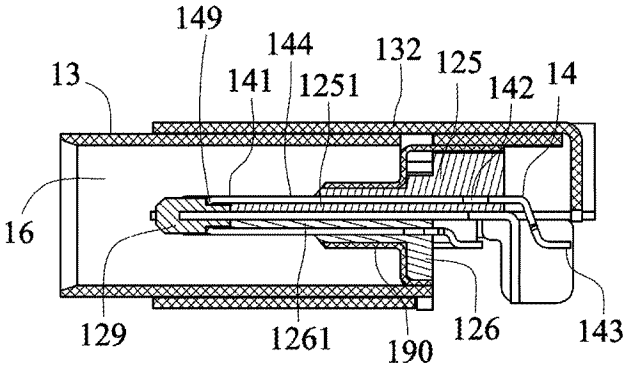
FIG. 66 is a side cross-sectional view according to the 19th embodiment of the invention.
Figure 67:
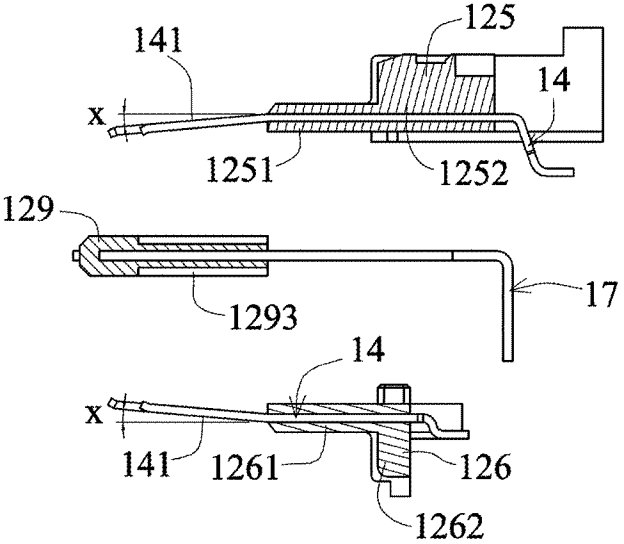
FIG. 67 is a partially exploded side cross-sectional view according to the 19th embodiment of the invention.

Referring to FIGS. 66 and 67, the 19th embodiment of the invention is a dual-position duplex USB TYPE-C electrical connection socket, and is substantially the same as the 18th embodiment except for the difference that the lengths of the two rows of terminals 14 of this embodiment extending out of the contacts 141 of the outer ends of the upper and lower tongues 1251 and 1261 have the resilient overpressure leaning against the outer tongue seat 129. Thus, after the overall parts are combined together, the upper and lower tongues 1251 and 1261 can tightly clamp the metal partition plate 17 by the resilient overpressure of the two rows of terminals 14 leaning against the outer tongue seat 129.

Figure 68:
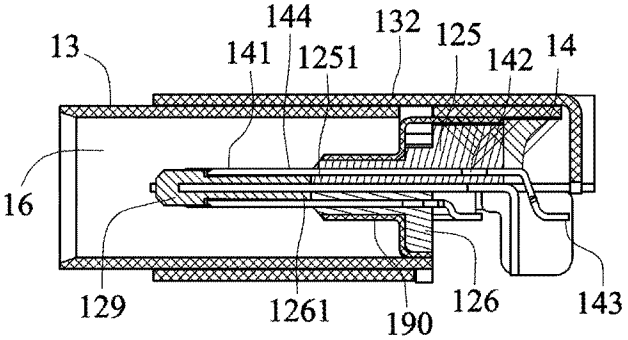
FIG. 68 is a side cross-sectional view of the invention 20th embodiment.
Figure 69:
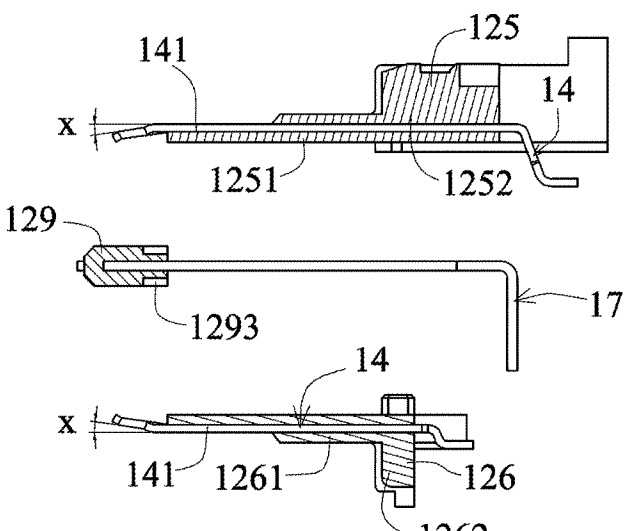
FIG. 69 is a partially exploded side cross-sectional view of the invention 20th embodiment.
Figure 70:
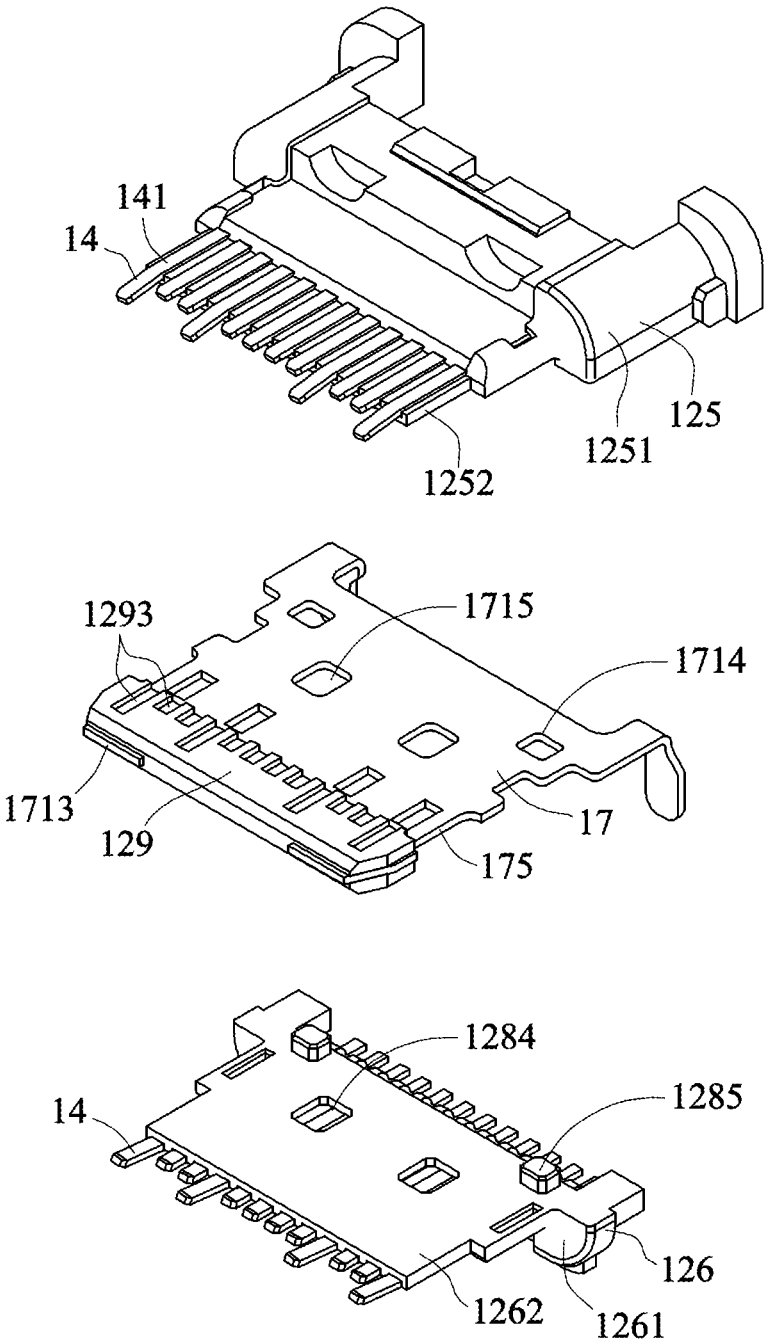
FIG. 70 is a partially pictorially exploded view of the invention 20th embodiment.

Referring to FIGS. 68 to 70, the 20th embodiment of the invention is a dual-position duplex USB TYPE-C electrical connection socket, and is substantially the same as the 17th embodiment except for the difference that the lengths of the terminals of the four longer contacts 141 of the two rows of terminals 14 of this embodiment extending out of the contacts 141 of the outer ends of the upper and lower tongues 1251 and 1261 have the resilient overpressure leaning against the outer tongue seat 129. Thus, after the overall parts are combined together, the upper and lower tongues 1251 and 1261 can tightly clamp the metal partition plate 17 by the resilient overpressure of the two rows of terminals 14 leaning against the outer tongue seat 129.

Figure 72:
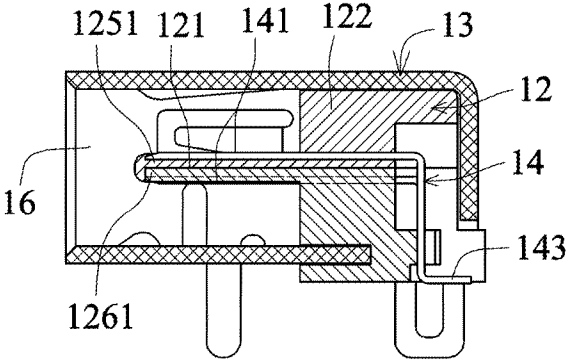
FIG. 72 is a side cross-sectional view according to the 21st embodiment of the invention.
Figure 71:
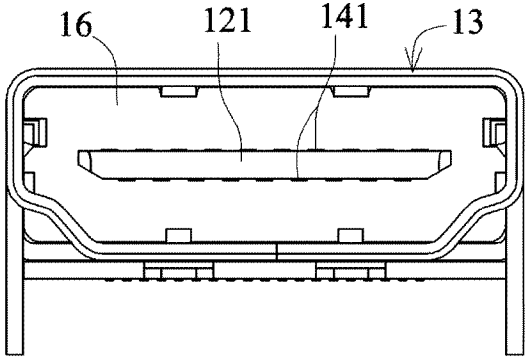
FIG. 71 is a front view according to the 21st embodiment of the invention.
Figure 73:
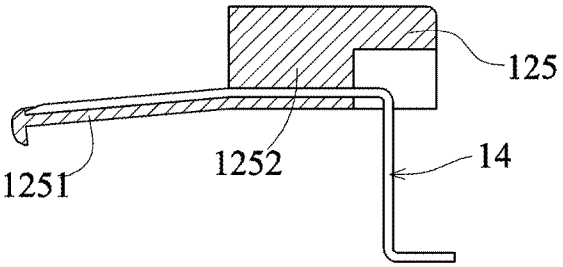
FIG. 73 is an exploded side cross-sectional view showing the first and second seats according to the 21st embodiment of the invention.
Figure 73:
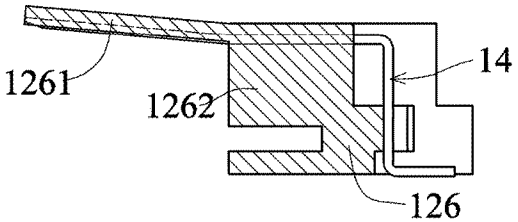

Referring to FIGS. 71 to 73, the 21st embodiment of the invention is a HDMI electrical connection socket, and is substantially the same as the fifth embodiment except for the difference that the two rows of contacts 141 of the top and bottom surfaces of the tongue 121 of this embodiment respectively contain 10 and 9 contacts cross-interleaving in the left-to-right direction, the two rows of contacts 141 form the HDMI contact interface, and the shape of the connection slot 55 is asymmetrical in the top-to-bottom direction to provide the mistake-proof effect, so that the electrical connection can be made at one single position. Similar to the fifth embodiment, the first and second tongues 1251 and 1261 are provided with the resilient overpressure leaning against the jointing surface. That is, the outer sections of the first and second tongues 1251 and 1261 are inclined by an angle toward the jointing surface, so that when the first and second tongues 1251 and 1261 are stacked, the first and second tongues 1251 and 1261 resiliently press against and tightly contact with each other through the resilient overpressure leaning against the jointing surface.

While the present invention has been described by way of examples and in terms of preferred embodiments, it is to be understood that the present invention is not limited thereto. To the contrary, it is intended to cover various modifications. Therefore, the scope of the appended claims should be accorded the broadest interpretation so as to encompass all such modifications.

What is claimed is:

1. An electric connector, comprising:

an insulated seat comprising a base seat and a tongue, wherein one end of the base seat is projectingly provided with the tongue, an inner end of the tongue is connected to the base seat, an outer end of the tongue is a free end, plate surfaces of two larger areas of the tongue are two connection surfaces, and the other two opposite edges of the tongue facing inner and outer ends are two sides;

two terminal sets disposed on the insulated seat, wherein each of the terminal sets is provided with at least one row of terminals, one end of the terminal is extended and provided with a contact and the other end of each of the terminals is extended and provided with a pin, and the contacts of the two terminal sets are respectively disposed on the two connection surfaces of the tongue, respectively; and a metal housing covering the insulated seat and resting and positioning against the base seat, wherein the metal housing is formed with a connection slot, the tongue is disposed at a middle height of the connection slot, the two connection surfaces of the tongue form two symmetrical spaces, and the connection slot can be inserted and positioned by an electric connector in a reversible dual-position manner;

characterized in that the insulated seat is provided with a first seat and a second seat mutually stacked and assembled together, the first and second seats are fixed to the terminal sets, the first seat is integrally formed with a first base seat and a first tongue, the second seat is integrally formed with a second base seat and a second tongue, the first and second base seats are stacked to form the base seat, the tongue comprises the first and second tongues stacked and assembled together, and an outer edge of the tongue is in the form of an integrally formed full height.

2. The electric connector according to claim 1, characterized in that heights of the two symmetrical spaces are larger than 0.28 mm and smaller than 0.97 mm, wherein the biased electrical connection socket comprises a connection slot, and a tongue is disposed in the connection slot in a vertically biased manner, wherein two corresponding surfaces of the tongue form the large space and the small space, and one surface of the tongue facing the large space is provided with one set of contacts.

3. The electric connector according to claim 1, characterized in that the electric connector is further provided with two ground shielding sheets of a metal material, the two ground shielding sheets are positioned at the insulated seat and contact the metal housing, and the two ground shielding sheets are provided with two first plate sheets respectively covering inner sections of the two connection surfaces of the tongue.

4. The electric connector according to claim 3, characterized in that the two ground shielding sheets are integrally connected together to from a ground shielding member, at least one ground shielding sheet is provided with a second plate sheet forming a step together with the first plate sheet, and the second plate sheet covers the base seat and is electrically connected to the metal housing.

5. The electric connector according to claim 4, characterized in that the ground shielding member is provided with a four-sided housing, and the four-sided housing is fitted with and positioned at the insulated seat.

6. The electric connector according to claim 5, characterized in that the electric connector is one of (a) to (g) or a combination of more than one of (a) to (g):

(a) wherein the four-sided housing is formed with the first plate sheet having the two ground shielding sheets, and the four-sided housing is fitted with and positioned at an inner section of the tongue;

(b) wherein the four-sided housing is formed with the first plate sheet having the two ground shielding sheets, the four-sided housing is fitted with and positioned at the inner section of the tongue, a middle of the insulated seat is provided with a metal partition plate, the metal partition plate extends from the base seat to the tongue to separate the contacts of the two terminal sets, two sides of the metal partition plate are provided with laterally projecting convex portions, and two side plates of the four-sided housing contact the convex portions of the two sides of the metal partition plate of;

(c) wherein both of the two ground shielding sheets are provided with the second plate sheets, the four-sided housing is formed with the second plate sheet having the two ground shielding sheets, and the four-sided housing is fitted with and positioned at the base seat;

(d) wherein both of the two ground shielding sheets are provided with the second plate sheets;

(e) wherein the ground shielding member is formed by bending a metal plate sheet, and the four-sided housing is combined and engaged together on a plate surface;

(f) wherein the four-sided housing of the ground shielding member has no seam; and (g) wherein the tongue has a thickness of the inner section thicker than an outer section of the inner section so that the inner sections of the two connection surfaces project much more than the outer sections of the two connection surfaces.

7. The electric connector according to claim 1, characterized in that the first and second tongues are provided with tongue snapping structures mutually engaged with each other, and the tongue snapping structure has snapping structures mutually limiting and engaging with each other in a direction perpendicular to the two connection surfaces of the tongue.

8. The electric connector according to claim 1, characterized in that the first and second base seats are provided with base seat snapping structures mutually engaged with each other, and the base seat snapping structure has snapping structures mutually limiting and engaging with each other in a direction perpendicular to the two connection surfaces of the tongue.

9. The electric connector according to claim 1, characterized in that the electric connector is one of (a) to (l) or a combination of more than one of (a) to (l):

(a) wherein an external shape of the connection slot is top-bottom symmetrical and left-right symmetrical, the tongue is disposed at a middle height of the connection slot, and the two connection surfaces of the tongue form two symmetrical spaces;

(b) wherein a thickness of the base seat is larger than that of the tongue;

(c) wherein the contacts of the two terminal sets are in flat surface contact with the connection surfaces of the tongue and are not elastically movable;

(d) wherein the contacts of the two terminal sets are respectively fixed to the two connection surfaces of the tongue in a flat surface contact manner and are not elastically movable, the contacts of the two terminal sets are in the forms of two rows of different lengths, and the lengths of the contacts of the two terminal sets are correspondingly arranged reversely;

(e) wherein each of the two terminal sets is one row of 12 terminals having the contacts, which are not elastically movable;

(f) wherein the two connection surfaces of the tongue horizontally extend frontwards, an inlet of the connection slot faces frontwards, and an outer end of the tongue is a front end of the tongue; or wherein the two connection surfaces of the tongue extend vertically upwards, and the inlet of the connection slot faces upwards; or wherein the two connection surfaces of the tongue stand vertically and extend frontwards, and the inlet of the connection slot faces frontwards;

(g) wherein the contacts of the two terminal sets are vertically aligned;

(h) wherein the contacts of the two terminal sets are arranged in an equally spaced manner;

(i) wherein the first base and one of the terminal sets are embedded and injection molded together, and the second base and the other one of the terminal sets are embedded and injection molded together;

(j) wherein the contacts of the two terminal sets have connection points with circuit serial numbers arranged reversely;

(k) wherein the contacts of the two terminal sets have the same contact interface and connection points with circuit serial numbers arranged reversely; and (l) wherein each of two sides of the connection slot provided with a metal engaging structure.

10. The electric connector according to claim 7, characterized in that the electric connector is one of (a) to (g) or a combination of more than one of (a) to (g):

(a) wherein snapping surfaces of the tongue snapping structures snapping together are horizontal surfaces;

(b) wherein each of the at least two terminal sets are arranged in one row, and the contacts of the two rows of terminals are vertically aligned;

(c) wherein an outer end of one of the first and second tongues is provided with at least one engaging slot, an outer end of the other of the first and second tongues is provided with at least one snapping convex portion fitted into and snapped to the one row of engaging slots, and the tongue snapping structure is the at least one snapping convex portion snapping to the at least one engaging slot;

(d) wherein the outer end of the one of the first and second tongues is provided with at least one engaging slot, the outer end of the other of the first and second tongues is provided with at least one snapping convex portion fitted into and snapped to the one row of engaging slots, the at least one snapping convex portion of the other one is formed by a distal end of at least one terminal formed thereon, and the tongue snapping structure is the at least one snapping convex portion snapping to the at least one engaging slot;

(e) wherein the tongue snapping structure is disposed on the outer ends of the first and second tongues;

(f) wherein two sides of the first base seat are provided with two lateral arms connected to two sides of the second base seat, respectively; and (g) wherein the contacts of the two terminal sets are not elastically movable and have different lengths, the lengths of the contacts of the two terminal sets are correspondingly arranged reversely, the distal end of the terminal of the shorter contact of the second tongue is convex upwards and provided with the snapping convex portion projecting beyond a front end of the second tongue, the distal end of the terminal of the longer contact horizontally projects beyond the front end of the second tongue, a front end of the first tongue projects downwards and is provided with one row of engaging slots, a bottom of the front end of the first tongue is flush with a bottom of the second tongue and provided with at least one space providing slots to be connected to the terminal of the longer contact of the second tongue, the snapping convex portion of the distal end of the terminal of the shorter contact of the second tongue is fitted into and snapping to the one row of engaging slots from rear to front, and the tongue snapping structure is the one row of snapping convex portions snapping to the one row of engaging slots.

11. The electric connector according to claim 3, characterized in that the electric connector is one of (a) to (d) or a combination of more than one of (a) to (d):

(a) wherein the ground shielding sheet is provided with a second plate sheet forming a step together with the first plate sheet, and the second plate sheet covers the base seat and is electrically connected to the metal housing;

(b) wherein the ground shielding sheet is provided with a second plate sheet forming a step together with the first plate sheet, the second plate sheet covers the base seat and is electrically connected to the metal housing, a vertical sheet is present between the first and second plate sheets and two sides are projectingly provided with engaging portions, respectively, and the engaging portions are engaged with the base seat;

(c) wherein the ground shielding sheet is provided with a second plate sheet forming a step together with the first plate sheet, the second plate sheet covers the base seat and is electrically connected to the metal housing, a vertical sheet is present between the first and second plate sheets, the first plate sheet is further connected to another vertical sheet, and the two vertical sheets are correspondingly connected to the first plate sheet and in the form of a U-shaped body engaged with the base seat; and (d) wherein the ground shielding sheet is provided with a second plate sheet forming a step together with the first plate sheet, the second plate sheet covers the base seat and is electrically connected to the metal housing, and each of two sides of the first plate sheet is provided with an engaging portion perpendicularly engaged with the tongue.

12. The electric connector according to claim 1, characterized in that a metal partition plate is positioned and provided between the first and second seats, and the metal partition plate extends from the base seat to the tongue.

13. The electric connector according to claim 12, characterized in that the electric connector is one of (a) to (d) or a combination of more than one of (a) to (d):

(a) wherein each of two sides of the outer section of the metal partition plate is provided with an engaging slot, each of two sides of the first and second tongues is provided with a slot corresponding to the engaging slot; or wherein each of the two sides of the outer section of the metal partition plate is provided with the engaging slot, and each of two sides of the first and second tongues is provided with a slot corresponding to the engaging slot, and the metal partition plate has a sufficient structural strength in a length range of the engaging slot and approaches a complete plate surface;

(b) wherein a front edge of the metal partition plate and the first tongue rest and limit against each other, a rear edge of the metal partition plate and the second base seat rest and limit against each other, and the metal partition plate is snapped to the first tongue from rear to front;

(c) wherein the metal partition plate is provided with at least one pin extending to an outside of the insulated seat; and (d) wherein a plate surface of the metal partition plate is provided with at least one longitudinal opening in a front-rear direction, an inner surface of the first tongue is provided with an engagement block, which can be fit with and slide relative to the longitudinal opening, and when the metal partition plate moves frontwards, a rear edge of the longitudinal opening and a rear edge of the engagement block may rest and limit each other.

14. The electric connector according to claim 1, characterized in that the tongue further comprises an outer tongue seat, the outer tongue seat is positioned at outer ends of the first and second tongues to form the tongue, and an outer end of the outer tongue seat forms an outer edge of the tongue.

15. The electric connector according to claim 14, characterized in that the electric connector is one of (a) to (g) or a combination of more than one of (a) to (g):

(a) wherein two connection surfaces of the outer tongue seat are provided with depressed portions for providing spaces for the terminal sets of the first and second tongues;

(b) wherein a metal partition plate is provided between the first and second seats, and the metal partition plate extends from the base seat to the tongue and has one end snapped and fixed to the outer tongue seat;

(c) wherein a metal partition plate is provided between the first and second seats, and the metal partition plate extends from the base seat to the tongue and has one end embedded and fixed into the outer tongue seat;

(d) wherein a metal partition plate is provided between the first and second seats, the metal partition plate extends from the base seat to the tongue and has two sides each provided with an engaging slot, and two sides of a combination of the first and second tongues and an outer seat of the tongue form a slot corresponding to the engaging slot of the metal partition plate;

(e) wherein the outer tongue seat is provided with separate engagement holes, each of the outer ends of the first and second tongues is projectingly provided with snapping convex portions, and the snapping convex portions of the first and second tongues correspondingly engage with the engagement holes of the outer tongue seat;

(f) wherein the outer tongue seat is provided with separate engagement holes, each of the outer ends of the first and second tongues is projectingly provided with snapping convex portions, the snapping convex portions of the first and second tongues correspondingly engage with the engagement holes of the outer tongue seat, and the snapping convex portions of the first and second tongues are formed by end sections of the terminals thereon; and (g) wherein the outer tongue seat is provided with separate engagement holes, each of the outer ends of the first and second tongues is projectingly provided with snapping convex portions, the snapping convex portions of the first and second tongues correspondingly engage with the engagement holes of the outer tongue seat, the snapping convex portions of the first and second tongues are staggered and disposed at a middle thickness of the tongue and arranged in one row, and the engagement holes of the outer tongue seat are arranged in one row.

16. The electric connector according to claim 12, characterized in that the tongue comprises an outer tongue seat, one end of the metal partition plate is fixed to the outer tongue seat, each of two connection surfaces of the outer tongue seat is provided with one row of depressed portions, end sections of the terminals of the terminal sets of the first and second tongues project beyond outer ends of the first and second tongues and are connected to the row of depressed portions of the two connection surfaces of the outer tongue seat, and an outer end of the outer tongue seat forms an outer edge of the tongue.

17. The electric connector according to claim 16, characterized in that the electric connector is one of (a) to (h) or a combination of more than one of (a) to (h):

(a) wherein the contacts of the terminal sets of the first and second tongues are not elastically movable;

(b) wherein the contacts of the terminal sets of the first and second tongues are not elastically movable and are in flat surface contact with and connected to the row of depressed portions of the two connection surfaces of the outer tongue seat;

(c) wherein the contacts of the terminal sets of the first and second tongues are not elastically movable and the distal ends of the terminals are slightly bent toward the row of depressed portions of the two connection surfaces of the outer tongue seat, and are lower than the connection surface;

(d) wherein each of two sides of the metal partition plate is provided with an engaging slot, and two sides of a combination of the first and second tongues and an outer seat of the tongue form slots corresponding to the engaging slots of the metal partition plate;

(e) wherein the outer ends of the first and second tongues rest against the outer tongue seat;

(f) wherein the first and second seats and the metal partition plate are limited and engaged with each other except for in a direction perpendicular to the two connection surfaces of the tongue;

(g) wherein each of the first tongue of the first base and the second tongue of the second base has an inner section and an outer section thinner than the inner section, the stacked first and second tongues form inner and outer sections of the tongue, the outer tongue seat is flush with, positioned at and combined with the outer ends of the first and second tongues, the inner section of the tongue is thicker than the outer section of the tongue so that inner sections of the two jointing surfaces project much more than outer sections of the two jointing surfaces, the contacts of the two terminal sets are elastically non-movable and in flat surface contact with and embedded and fixed to the outer section of the tongue and the end section of the terminal projects beyond the outer sections of the first and second tongues, and the end sections of the terminals of the two terminal sets are connected to one row of concave portions of the two jointing surfaces of the outer tongue seat;

(h) wherein one end of the metal partition plate is embedded and fixed into the outer tongue seat;

(i) wherein the contacts of the two terminal sets are elastically non-movable and have first surfaces exposed from the two jointing surfaces of the tongue, respectively, and have second surfaces embedded into and in flat surface contact with and fixed to the first and second tongues; and (j) wherein the stacked first and second tongues form the inner section of the tongue, the outer tongue seat forms the outer section of the tongue, the inner section of the tongue is thicker than the outer section of the tongue so that the inner sections of the two jointing surfaces project much more than the outer sections of the two jointing surfaces, the contacts of the two terminal sets are elastically non-movable and project beyond the outer ends of the first and second tongues, and the contacts of the two terminal sets are in flat surface contact with and connected to one row of concave portions of the two jointing surfaces of the outer tongue seat.

18. The electric connector according to claim 16, characterized in that the electric connector is one of (a) to (b) or a combination of more than one of (a) to (b):

(a) wherein the end sections of the terminals of the terminal sets of the first and second tongues have a resilient overpressure leaning against the outer tongue seat and connected to one row of depressed portions of the two connection surfaces of the outer tongue seat, so that after the overall parts are assembled, and the upper and lower tongues can tightly clamp the metal partition plate by the resilient overpressure of the two rows of terminals leaning against the outer tongue seat; and (b) wherein extending lengths of the contacts of the terminals of the terminal sets of the first and second tongues have a resilient overpressure leaning against the outer tongue seat and connected to one row of concave portions of the two jointing surfaces of the outer tongue seat, so that after overall parts are assembled, the upper and lower tongues can tightly clamp the metal partition plate through the resilient overpressure of the two rows of terminals leaning against the outer tongue seat.

19. The electric connector according to claim 1, characterized in that the outer edge of the tongue is integrally formed with one of the first and second tongues.

20. The electric connector according to claim 19, characterized in that the first tongue is provided with the outer edge of the tongue, a front section of the first tongue has a thicker convex surface, the convex surface is provided with space providing slots, and the space providing slots can be connected to outer sections of the terminals on the second tongue.

21. The electric connector according to claim 1, characterized in that at least one of the first and second tongues is provided with a resilient overpressure leaning against a jointing surface, so that when the first and second tongues are stacked together, the first and second tongues are stably positioned through the resilient overpressure leaning against the jointing surface.

22. An electrical connection socket, comprising:

an insulated seat provided with a base seat and a tongue, wherein one end of the base seat is projectingly provided with the tongue, an inner end of the tongue is connected to the base seat, and the tongue is provided with two connection surfaces with larger plate surfaces;

two terminal sets disposed on the insulated seat, wherein each of the terminal sets is provided with at least one row of terminals, one end of the terminal is extended and provided with a contact and the other end of each of the terminals is extended and provided with a pin extending out of the base seat, and the contacts of the two terminal sets are respectively exposed from the two connection surfaces of the tongue; and a metal housing covering the insulated seat and provided with a four-sided primary housing, wherein the four-sided primary housing is formed with a connection slot, the tongue is disposed in the connection slot, an outer end of the tongue approaches an insert port of the connection slot, and the connection slot can be electrically connected to an inserted docking electrical connection plug;

characterized in that the insulated seat is provided with a first seat and a second seat stacked together, the two terminal sets are respectively embedded into and injection molded with the first and second seats, the first seat is integrally formed with a first base seat and a first tongue, the second seat is integrally formed with a second base seat and a second tongue, the first and second base seats are stacked to form the base seat, the tongue comprises the stacked first and second tongues, the first and second base seats are stacked to form the base seat, and at least one of the first and second tongues is provided with a resilient overpressure leaning against a jointing surface, so that when the first and second tongues are stacked together, the first and second tongues are stably positioned through the resilient overpressure leaning against the jointing surface.

23. An electric connector, comprising:

an insulated seat provided with a base seat and a tongue, wherein one end of the base seat is projectingly provided with the tongue, an inner end of the tongue is connected to the base seat, an outer end of the tongue is a free end, and plate surfaces of two larger areas of the tongue are two connection surfaces;

two terminal sets disposed on the insulated seat, wherein each of the terminal sets is provided with at least one row of terminals, one end of the terminal is extended and provided with a contact and the other end of each of the terminals is extended and provided with a pin, and the contacts of the two terminal sets are respectively disposed on the two connection surfaces of the tongue, respectively; and a metal housing covering the insulated seat and resting and positioning against the base seat, wherein the housing is formed with a connection slot, the tongue is disposed at a middle height of the connection slot, the two connection surfaces of the tongue form two symmetrical spaces, and the connection slot can be inserted and positioned by an electric connector in a reversible dual-position manner;

characterized in that a middle of the insulated seat is provided with a metal partition plate, the metal partition plate extends from the base seat to the tongue and separates the two terminal sets, heights of the two symmetrical spaces are larger than 0.28 mm, and smaller than 0.97 mm.

24. A multi-layer electric connector, comprising:

a first connector provided with a connection slot, wherein a tongue is provided at a middle height of the connection slot, plate surfaces of two larger areas of the tongue are two connection surfaces, each of the two connection surfaces is provided with a contact interface, the contact interface is formed by contacts of terminals of one of the terminal sets, each of the terminal sets is provided with at least one row of terminals, one end of the terminal is extended and provided with a contact, the other end of the terminal of is extended and provided with a pin, the contacts of the two terminal sets are disposed on the two jointing surfaces of the tongue, respectively, the connection slot forms two symmetrical spaces on the two connection surfaces of the tongue, and the connection slot can be inserted and positioned by an electric connector in a reversible dual-position manner; and a second connector provided with a connection slot, wherein at least one contact interface is provided in the connection slot, and the connection slot of the second connector and the connection slot of the first connector are arranged vertically in a multi-layer manner;

characterized in that two symmetrical spaces of the connection slot of the first connector on two connection surfaces of the tongue are larger than 0.28 mm, and smaller than 0.97 mm.

25. The multi-layer electric connector according to claim 24, characterized in that the electric connector is one of (a) to (k) or a combination of more than one of (a) to (k):

(a) wherein the contacts of the two terminal sets of the first connector are not elastically movable;

(b) wherein the contacts of the terminals of the two terminal sets of the first connector are not elastically movable and are in flat surface contact with the two connection surfaces;

(c) wherein the connection slot of the second connector and the connection slot of the first connector are formed by one metal housing;

(d) wherein the contacts of the two terminal sets are in flat surface contact with the jointing surfaces of the tongue and are elastically non-movable;

(e) wherein the contacts of the two terminal sets have connection points with circuit serial numbers arranged reversely;

(f) wherein the contacts of the two terminal sets have the same contact interface and connection points with circuit serial numbers arranged reversely;

(g) wherein each of two sides of the connection slot is provided with a metal engaging structure;

(h) wherein pins of the two terminal sets are pin structures on the same plane;

(i) wherein the contacts of the two terminal sets are in flat surface contact with the jointing surfaces of the tongue and are elastically non-movable;

(j) wherein the contacts of the two terminal sets are aligned vertically; and (k) wherein the contacts of the two terminal sets are arranged in an equally spaced manner.

26. The electrical connector according to claim 1, characterized in that the tongue further comprises an outer tongue seat, wherein a metal partition plate is provided between the first and second bases, the metal partition plate extends from the base to the tongue, the outer tongue seat is combined and fixed to outer ends of the first and second tongues to form the tongue together with an outer end of the metal partition plate, and an outer end of the outer tongue seat forms the outer edge of the tongue.

27. The electrical connector according to claim 22, characterized in that the electric connector is one of (a) to (l) or a combination of more than one of (a) to (l):

(a) wherein each of the first and second tongues is provided with a resilient overpressure leaning against the jointing surface, and the contacts of the two terminal sets are in flat surface contact with the jointing surfaces of the tongue and are elastically non-movable;

(b) wherein the contacts of the terminal set on at least one of the first and second tongues project beyond a front end of one of the first and second tongues, the projecting contacts of the terminal set are provided with the resilient overpressure leaning against the jointing surface of the first and second tongues;

(c) wherein extending lengths of the contacts of the terminals of the terminal set on at least one of the first and second tongues have the resilient overpressure leaning against the jointing surface of the first and second tongues;

(d) wherein two symmetrical spaces of the connection slot on the two jointing surfaces of the tongue are larger than 0.28 mm, and smaller than 0.97 mm;

(e) wherein the contacts of the two terminal sets are in flat surface contact with the jointing surfaces of the tongue and are elastically non-movable;

(f) wherein the contacts of the two terminal sets have connection points with circuit serial numbers arranged reversely;

(g) wherein the contacts of the two terminal sets have the same contact interface and connection points with circuit serial numbers arranged reversely;

(h) wherein each of two sides of the connection slot is provided with a metal engaging structure;

(i) wherein the pins of the two terminal sets are pin structures on the same plane;

(j) wherein the contacts of the two terminal sets are in flat surface contact with the jointing surfaces of the tongue and are elastically non-movable;

(k) wherein the contacts of the two terminal sets are aligned vertically; and (l) wherein the contacts of the two terminal sets are arranged in an equally spaced manner.

28. The electrical connector according to claim 23, characterized in that the two terminal sets are concurrently embedded and plastic injection molded with the insulation base and the tongue.

29. The electrical connector according to claim 23, characterized in that the electric connector is one of (a) to (e) or a combination of more than one of (a) to (e):

(a) wherein the contacts of the two terminal sets are in flat surface contact with the jointing surfaces of the tongue and are elastically non-movable;

(b) wherein the contacts of the two terminal sets have connection points with circuit serial numbers arranged reversely;

(c) wherein the contacts of the two terminal sets have the same contact interface and connection points with circuit serial numbers arranged reversely;

(d) wherein each of two sides of the connection slot is provided with a metal engaging structure;

(e) wherein the pins of the two terminal sets are pin structures on the same plane;

(f) wherein the contacts of the two terminal sets are in flat surface contact with the jointing surfaces of the tongue and are elastically non-movable;

(g) wherein the contacts of the two terminal sets are aligned vertically;

(h) wherein the contacts of the two terminal sets are arranged in an equally spaced manner; and (i) wherein the contacts of the two terminal sets are arranged in a top-bottom staggered manner.

* * * * *